US010869551B2

(12) United States Patent
Kramer et al.

(10) Patent No.: US 10,869,551 B2
(45) Date of Patent: Dec. 22, 2020

(54) PORTABLE PAPER ORGANIZER

(71) Applicants: Teri Kramer, Fort Worth, TX (US); Bill R. Naifeh, Dallas, TX (US)

(72) Inventors: Teri Kramer, Fort Worth, TX (US); Bill R. Naifeh, Dallas, TX (US)

(73) Assignee: Teri Kramer, Fort Worth, TX (US)

( * ) Notice: Subject to any disclaimer, the term of this patent is extended or adjusted under 35 U.S.C. 154(b) by 0 days.

(21) Appl. No.: 16/530,057

(22) Filed: Aug. 2, 2019

(65) Prior Publication Data

US 2020/0029688 A1 Jan. 30, 2020

Related U.S. Application Data

(63) Continuation of application No. 15/617,660, filed on Jun. 8, 2017, now Pat. No. 10,405,651, which is a (Continued)

(51) Int. Cl.
*A47B 63/00* (2006.01)
*A47B 46/00* (2006.01)
(Continued)

(52) U.S. Cl.
CPC ..... *A47B 63/00* (2013.01); *A47B 46/005* (2013.01); *A47B 57/045* (2013.01); *A47B 57/10* (2013.01); *A47B 57/34* (2013.01); *A47B 96/027* (2013.01); *A47F 5/06* (2013.01); *A47F 7/16* (2013.01); *A47B 2063/005* (2013.01)

(58) Field of Classification Search
CPC ..... A47B 46/005; A47B 57/045; A47B 57/10; A47B 57/34; A47B 63/00; A47B 96/028; A47B 96/027; A47B 2063/005; A47F 5/04; A47F 5/06; A47F 7/16; A47F 7/163; A47F 7/144
USPC ..... 211/45, 50, 133.1, 133.3, 133.4, 186, 211/187, 144, 205, 131.1
See application file for complete search history.

(56) References Cited

U.S. PATENT DOCUMENTS 109,602 A 11/1870 Evans
274,087 A 3/1883 Danner
(Continued)

FOREIGN PATENT DOCUMENTS

CH 346430 A * 5/1960 ..... A47B 57/045
DE 2019457 A1 11/1971
(Continued)

OTHER PUBLICATIONS

Global Industries, "Double-Sided Mobile Rack with Bins," Model T9L550170YL, www.globalindustries.com, published prior to Feb. 7, 2014.
(Continued)

*Primary Examiner* — Stanton L Krycinski
(74) *Attorney, Agent, or Firm* — Bill R. Naifeh

(57) ABSTRACT

Disclosed are various embodiments of a free standing paper organizational system comprising: a base; at least one vertical support member having a first end and a second end, wherein the first end is coupled to the base; a handle component coupled to the second end of the at least one vertical support member; at least one fixed or removable shelf unit comprising a first shelf member extending from the vertical support member at a predetermined angle.

12 Claims, 31 Drawing Sheets

Related U.S. Application Data continuation of application No. 14/617,638, filed on Feb. 9, 2015, now abandoned.

(60) Provisional application No. 61/937,459, filed on Feb. 7, 2014.

(51) Int. Cl.

| | |
|---|---|
| ***A47B 57/04*** | (2006.01) |
| ***A47B 57/10*** | (2006.01) |
| ***A47B 57/34*** | (2006.01) |
| ***A47B 96/02*** | (2006.01) |
| ***A47F 5/06*** | (2006.01) |
| ***A47F 7/16*** | (2006.01) |

(56) References Cited

U.S. PATENT DOCUMENTS

| | | | | |
|---|---|---|---|---|
| 727,107 | A | 5/1903 | Donaldson | |
| 770,903 | A | 9/1904 | Holt | |
| 844,754 | A | 2/1907 | Sardou et al. | |
| 929,897 | A | 8/1909 | Taylor | |
| 1,065,381 | A | 6/1913 | Martin | |
| 1,554,137 | A * | 9/1925 | Slifkin | A47B 57/52 108/6 |
| 1,570,651 | A | 1/1926 | Topping et al. | |
| 1,889,829 | A | 12/1932 | Govier et al. | |
| 1,900,610 | A | 3/1933 | Mullins | |
| 2,289,212 | A | 7/1942 | Rinnela | |
| 2,316,892 | A | 4/1943 | Saul, Jr. | |
| 2,579,704 | A | 12/1951 | Saul, Jr. | |
| 2,760,647 | A | 8/1956 | Saul, Jr. | |
| 2,953,257 | A | 9/1960 | McNeill | |
| 3,015,466 | A | 1/1962 | Levy | |
| 3,081,718 | A | 3/1963 | Shoffner | |
| 3,126,844 | A | 3/1964 | Burne et al. | |
| 3,132,609 | A * | 5/1964 | Chesley | A47B 57/04 108/106 |
| 3,135,389 | A | 6/1964 | Farley | |
| 3,243,047 | A | 3/1966 | Witteborg | |
| 3,343,685 | A * | 9/1967 | Giambalvo | A47B 47/042 108/108 |
| 3,414,133 | A | 12/1968 | Guerri et al. | |
| 3,428,187 | A | 2/1969 | Baggott | |
| 3,517,623 | A | 6/1970 | Goldstein et al. | |
| 3,543,943 | A | 12/1970 | Joy et al. | |
| 3,791,528 | A | 2/1974 | Brendgord | |
| 3,908,831 | A | 9/1975 | Brendgord | |
| 4,037,851 | A | 7/1977 | Romero | |
| D250,301 | S | 11/1978 | Handler et al. | |
| 4,126,366 | A | 11/1978 | Handler et al. | |
| 4,140,223 | A | 2/1979 | Rau et al. | |
| 4,197,950 | A | 4/1980 | Ovitz, III | |
| 4,240,684 | A | 12/1980 | Henning | |
| 4,312,086 | A | 1/1982 | Bianco | |
| 4,345,526 | A | 8/1982 | Streit | |
| 4,444,323 | A | 4/1984 | Travis | |
| 4,480,755 | A | 11/1984 | Cartwright | |
| 4,531,645 | A | 7/1985 | Tisbo et al. | |
| 4,537,316 | A | 8/1985 | Simon et al. | |
| D288,147 | S | 2/1987 | Helinsky | |
| 4,678,089 | A | 7/1987 | Lang | |
| 4,736,856 | A | 4/1988 | Alneng et al. | |
| 4,889,377 | A | 12/1989 | Hughes | |
| 4,898,281 | A | 2/1990 | Cherry | |
| 4,919,282 | A | 4/1990 | Duff et al. | |
| 5,022,537 | A | 6/1991 | Henriquez | |
| 5,035,321 | A | 7/1991 | Denton | |
| 5,101,997 | A | 4/1992 | Bagwell et al. | |
| 5,205,638 | A | 4/1993 | Squitieri | |
| 5,240,264 | A | 8/1993 | Williams | |
| 5,337,904 | A | 8/1994 | Goldberg | |
| 5,464,104 | A | 11/1995 | McArthur | |
| 5,482,342 | A | 1/1996 | Kowalski et al. | |
| 5,531,168 | A | 7/1996 | Towtigh | |
| 5,595,395 | A | 1/1997 | Wilson | |
| D379,886 | S | 6/1997 | Towfigh | |
| 5,653,348 | A | 8/1997 | MacDonald | |
| 5,772,050 | A | 6/1998 | Shih | |
| 5,799,787 | A | 9/1998 | Talbot | |
| 5,813,528 | A | 9/1998 | Bliek et al. | |
| 5,899,423 | A * | 5/1999 | Albertini | A47B 13/02 248/188.8 |
| 5,921,414 | A | 7/1999 | Burke et al. | |
| 5,934,636 | A * | 8/1999 | Cyrell | A47B 57/56 248/220.21 |
| 6,302,280 | B1 * | 10/2001 | Bermes | B60R 9/00 211/175 |
| 6,477,966 | B1 | 11/2002 | Petryna | |
| 6,561,365 | B2 | 5/2003 | Bustos | |
| D477,726 | S | 7/2003 | Day | |
| 6,502,707 | B1 | 7/2003 | Sullivan | |
| 6,591,996 | B1 * | 7/2003 | Wu | A47B 57/26 211/103 |
| 6,705,655 | B2 | 3/2004 | Yang | |
| 6,805,246 | B1 | 10/2004 | Manabat | |
| 6,837,386 | B1 | 1/2005 | Kent et al. | |
| 7,213,951 | B2 | 5/2007 | Cowan | |
| D582,699 | S | 12/2008 | Nelson | |
| 7,540,510 | B2 | 6/2009 | Sparkowski | |
| 7,815,202 | B2 | 10/2010 | Richards et al. | |
| 7,891,633 | B2 | 2/2011 | Li | |
| 8,051,994 | B2 | 11/2011 | Jin et al. | |
| 8,225,946 | B2 * | 7/2012 | Yang | A47B 57/26 108/108 |
| 8,276,524 | B2 | 10/2012 | Goode et al. | |
| 8,763,821 | B2 * | 7/2014 | Yang | A47B 57/26 108/108 |
| 8,770,553 | B2 * | 7/2014 | Van Es | E04H 17/143 256/65.08 |
| 8,777,024 | B2 | 7/2014 | Kramer | |
| 8,985,351 | B1 | 3/2015 | Longo et al. | |
| 9,371,952 | B2 | 6/2016 | Kramer | |
| 9,894,989 | B2 | 2/2018 | Kramer | |
| 10,405,651 | B1 | 9/2019 | Kramer | |
| 10,426,264 | B2 | 10/2019 | Kramer | |
| 2005/0073119 | A1 | 4/2005 | Kirakosyan | |
| 2005/0183638 | A1 | 8/2005 | Lin | |
| 2006/0250057 | A1 | 11/2006 | Vasudeva | |
| 2007/0086840 | A1 | 4/2007 | Emrani et al. | |
| 2008/0142463 | A1 | 6/2008 | Johnson | |
| 2008/0143069 | A1 | 6/2008 | Richards et al. | |
| 2008/0156749 | A1 | 7/2008 | Shea | |
| 2009/0127413 | A1 | 5/2009 | Herron, III et al. | |
| 2011/0073553 | A1 | 3/2011 | Buege | |

FOREIGN PATENT DOCUMENTS

| | | | | |
|---|---|---|---|---|
| DE | 2428976 | A1 * | 1/1976 | A47B 47/05 |
| FR | 938318 | | 9/1948 | |
| FR | 57443 | | 1/1953 | |
| FR | 1200552 | A * | 12/1959 | A47B 57/045 |
| FR | 2641586 | A1 * | 7/1990 | A47B 57/34 |
| GB | 450838 | A * | 7/1936 | A47B 57/045 |
| GB | 2138751 | A | 10/1984 | |
| GB | 2201339 | A | 9/1988 | |
| JP | 6143159 | A | 5/1994 | |
| JP | 2001-218631 | A | 8/2001 | |

OTHER PUBLICATIONS

Global Industries, "Double-Sided Mobile Rack with Bins," www.globalindustries.com, published prior to Feb. 7, 2014.

Global Industries, "Stack and Lock Bins," www.globalindustries.com, published prior to Feb. 7, 2014.

International Search Report and Written Opinion, dated Sep. 20, 2012, by the ISA/US, re PCT/US2012/047575.

Restriction Requirement, dated Feb. 23, 2016, by the USPTO, re U.S. Appl. No. 14/617,638.

Office Action, dated Jul. 29, 2016, by the USPTO, re U.S. Appl. No. 14/617,638.

(56) References Cited

OTHER PUBLICATIONS

Final Office Action, dated Feb. 8, 2017, by the USPTO, re U.S. Appl. No. 14/617,638.
Office Action, dated Mar. 4, 2020, by the Uspto, re U.S. Appl. No. 16/564,620.

* cited by examiner

300

410

PORTABLE PAPER ORGANIZER

RELATED APPLICATIONS

This application is a continuation of U.S. patent application Ser. No. 15/617,660, filed Jun. 8, 2017, which is a continuation of U.S. patent application Ser. No. 14/617,638, filed Feb. 9, 2015, which claims the benefit of U.S. provisional application No. 61/937,459, filed Feb. 7, 2014. This application is related to a commonly owned U.S. patent application Ser. No. 13/197,405, filed Aug. 3, 2011. The disclosures of which are incorporated herein by reference for all purposes.

TECHNICAL FIELD

The present invention relates to an organizational and storage system comprising an array of shelf units for papers, files or books and a stand removably supporting the array of shelf units.

BACKGROUND INFORMATION

Many people have multiple projects "in process" at the same time with associated stacks for each project. Filing these stacks in a filing cabinet tends to put them out of mind. Additionally, most people desire the convenience of easy and ready access to in-process project stacks. Consequently, they keep the stacks for their in-process projects:

on the desktop in loose stacks, or in open-top stackable bins like "in baskets", or nearby in transportable carrying cases.

When a project is completed, many people file the associated stack in a filing cabinet, or throw all or part of it away.

Many people in home offices and workers in business offices have a limited amount of desk space and/or occasionally desire that their in-process project stacks be transportable so they can quickly and easily move their workspace to another area, and/or clear the look of clutter by moving their work out of sight, into a closet or other inconspicuous area.

Loose stacks often occupy all-too-limited desk space, tend to look cluttered, and are not easily transported. Furthermore, some studies show that stacks on a desktop tend to distract the user and prevent a user from focusing on the task at hand. Desktop stackable boxes, baskets or trays achieve more organization, but often occupy limited desk space. Additionally, they are not designed to be easily transported off of the desk. Although file carrying cases tend to be easily transportable, such cases when closed fail to provide easy and ready access to their contents or can occupy space and add to the impression of clutter when the top is left open.

A need therefore exists for a free-standing, transportable file and paper organizational and storage unit that also provides an easy and ready solution to the above problems.

SUMMARY

A system comprising: a vertical member supported by a base on a lower end and a handle on an upper end, the vertical member may support a plurality of shelf units, wherein each shelf unit in the plurality of shelf units may be positioned at various heights along the vertical member. In some embodiments, the system may be modular comprising a plurality of shelf units, vertical members, and handle units.

BRIEF DESCRIPTION OF THE DRAWINGS

FIG. 1A illustrates the aspect in an open or first configuration and FIG. 1B illustrates the aspect in a closed or second configuration.

FIG. 3A illustrates the aspect in an open or first configuration and FIG. 3B illustrates the aspect in a closed or second configuration.

FIG. 4A illustrates the aspect in an open or first configuration and FIG. 4B illustrates the aspect in a closed or second configuration.

FIG. 4D illustrates the aspect in an unassembled configuration and FIG. 4E illustrates the aspect in a partially assembled configuration.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in simplified form in order not to obscure the present invention in unnecessary detail.

When direction indicators, such as upper, lower, top, bottom, clockwise, counter-clockwise, are discussed in this disclosure, such direction indicators are meant to only supply reference directions for the illustrated figures and for orientation of components in the figures. The direction indicators should not be read to imply actual directions used in any resulting invention or actual use. Under no circumstances, should such direction indicators be read to limit or impart any meaning into the claims.

Figure 1A:
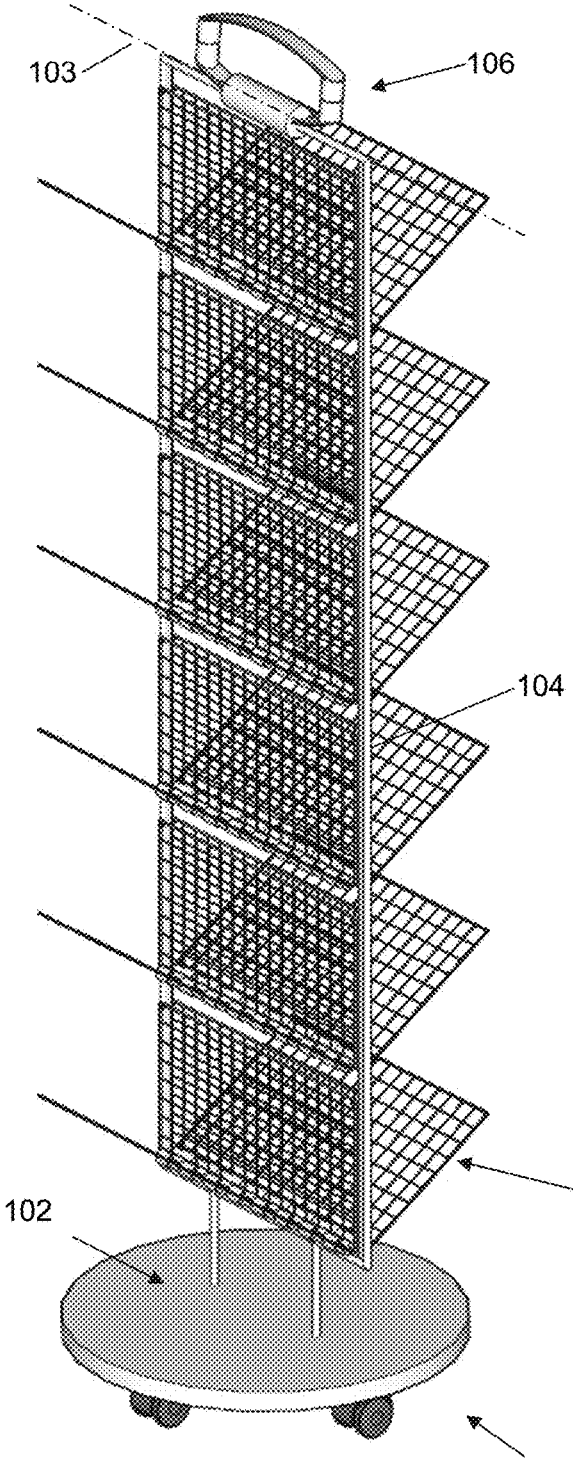
FIGS. 1A and 1B are isometric views illustrating one aspect of the present invention.
Figure 1B:
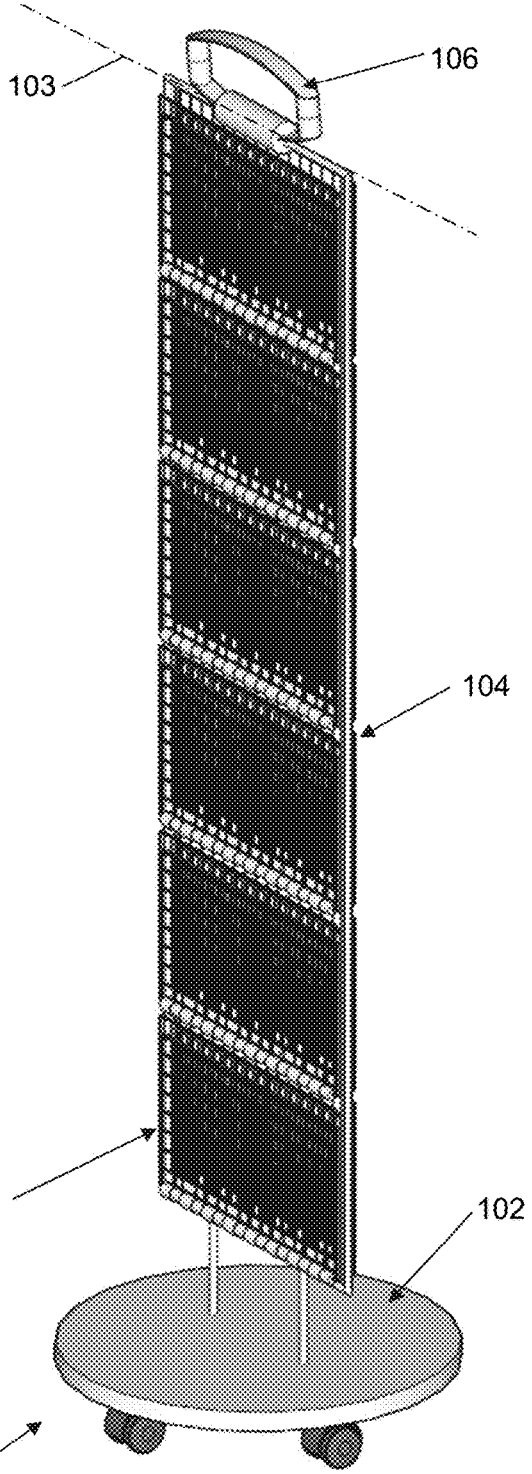

Turning now to FIGS. 1A and 1B, there is an organizational system 100 having a base 102, a vertical support 104, and a handle 106. The vertical support may be coupled to a plurality of shelf units 108. FIG. 1A illustrates the plurality of shelf units 108 in a open position or configuration. FIG. 1B illustrates the plurality of shelf units in an closed position or configuration.

Base

The base 102 may be any shape, including round, square, rectangular, triangular, hexagonal, or octagonal. In FIGS. 1A and 1B, the base 102 is illustrated as generally round. In other embodiments, the base 102 may comprise a plurality of legs arranged around a vertical axis in a radial manner (not shown). In yet other embodiments, the base 102 may be slightly conical in shape as illustrated by a base 602 in FIG. 6A. In certain embodiments, the base may be rectangular in footprint (not shown). The vertical support may couple to the base close to the floor or bottom end of the system 100 to provide a lower center of gravity for the system 100. In certain embodiments, there may be rectangular base having a plurality of horizontal and vertical cross members (not shown) to assist with structural stability.

In certain embodiments, the base 102 may be weighted to provide additional stability for the vertical support 104 when the vertical support is loaded. In certain embodiments, the base 102 may be coupled to a plurality of casters or rollers to allow for easy mobility. In yet other embodiments, the plurality of casters or rollers may be positionally biased so that they rise up when not in use. In other embodiments, the bottom surface of the base 102 (not shown) may have a Teflon or similar glideable coating or surface to allow the system to be moved by sliding across the carpet or floor.

Throughout this document, the various components and features of one embodiment are interchangeable with like components and features from other embodiments. For instance, a user might prefer a more conical shaped base, such as the bases of 602 or 702 (illustrated in FIGS. 6A and 7A, respectively) as opposed to the flattened base 102 of FIG. 1A. Turning now to FIG. 7A, the base 702 is generally conical in shape, having an enlarged round shape at its lower end which narrows to an apex at its upper end. FIG. 7E is a partial section view of the base 702. As discussed above, the base 702 comprises a round disc 724 designed to engage the floor. In certain embodiments, the disc 724 may be made from a dense material, such as a metal. The dense material keeps the center of gravity of the system 700 low which minimizes the chance that the system could turn on its side or become instable due to lateral forces. A base cover 726 is generally conical in shape and couples to the disc 724 at its exterior rim. The disc 724 also couples to the vertical support 704. Coupling the vertical support 704 to the disc 724 (as opposed to a higher element) also keeps the center of gravity of the system lower—increasing the lateral stability of the system 700.

As discussed above, in certain embodiments, the base 702 may have retractable wheels, such as wheels 728*a* and 728*b*. In other embodiments, the base may have a friction resistant surface, such as Teflon. The wheels 728 may be coupled to a center actuator 730 via a system of legs and hinges 732. Upon sensing a quick vertical movement, the center actuator 730 moves up, which causes the system of legs and hinges 732 to drop through apertures 734 defined within the disc 724. The wheels, which are coupled to the legs and hinges 732 follow and protrude through the apertures 734 so that they engage the floor. The system 700 can then be easily moved or transported by the user. When the destination is reached, the user can again cause a sudden vertical movement on the vertical support 704, which will cause the center actuator 730 to move down. The downward movement of the center actuator 730 now causes the system of legs and hinges 732 to move up through the apertures 734. Of course, the wheels 728 follow and are also drawn up through the apertures 734 so that the system cannot be as easily moved or transported.

Handle

In some embodiments, the handle 106 may be rotatable about an axis 103 which is lateral (e.g., horizontal) to a longitudinal or vertical axis of the vertical support 104. In certain embodiments, the handle 106 may have a stop to prevent the handle from rotating past 90 degrees from vertical. This allows a user to set a file or other papers temporarily on the handle if the user requires a temporary spot for the file while working with a portion of its contents or with a certain paper from a stack of papers. Other details relating to the handle are discussed below.

Figure 1C:
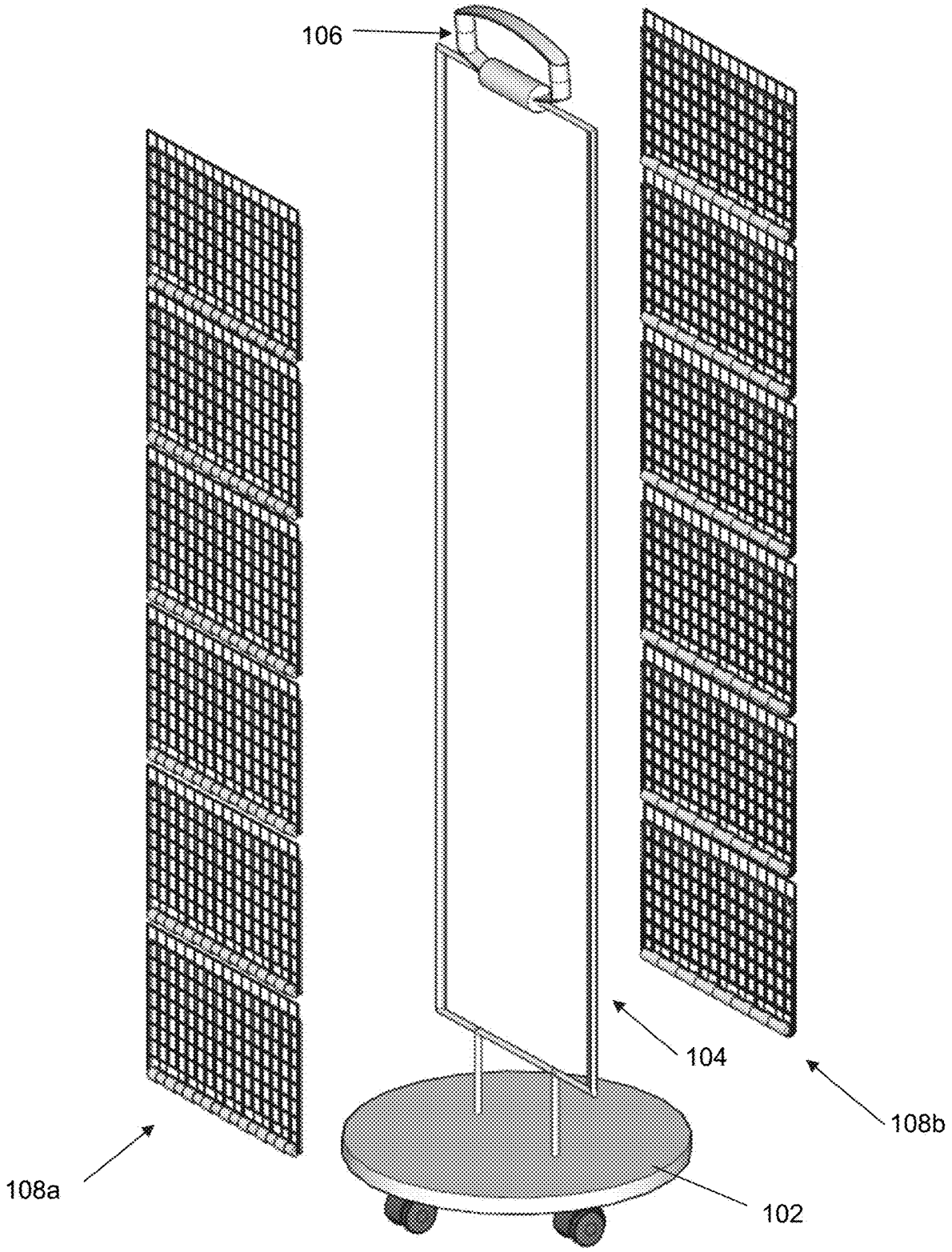
FIG. 1C is an exploded isometric view of the aspect illustrated in FIGS. 1A and 1B.
Figure 1D:
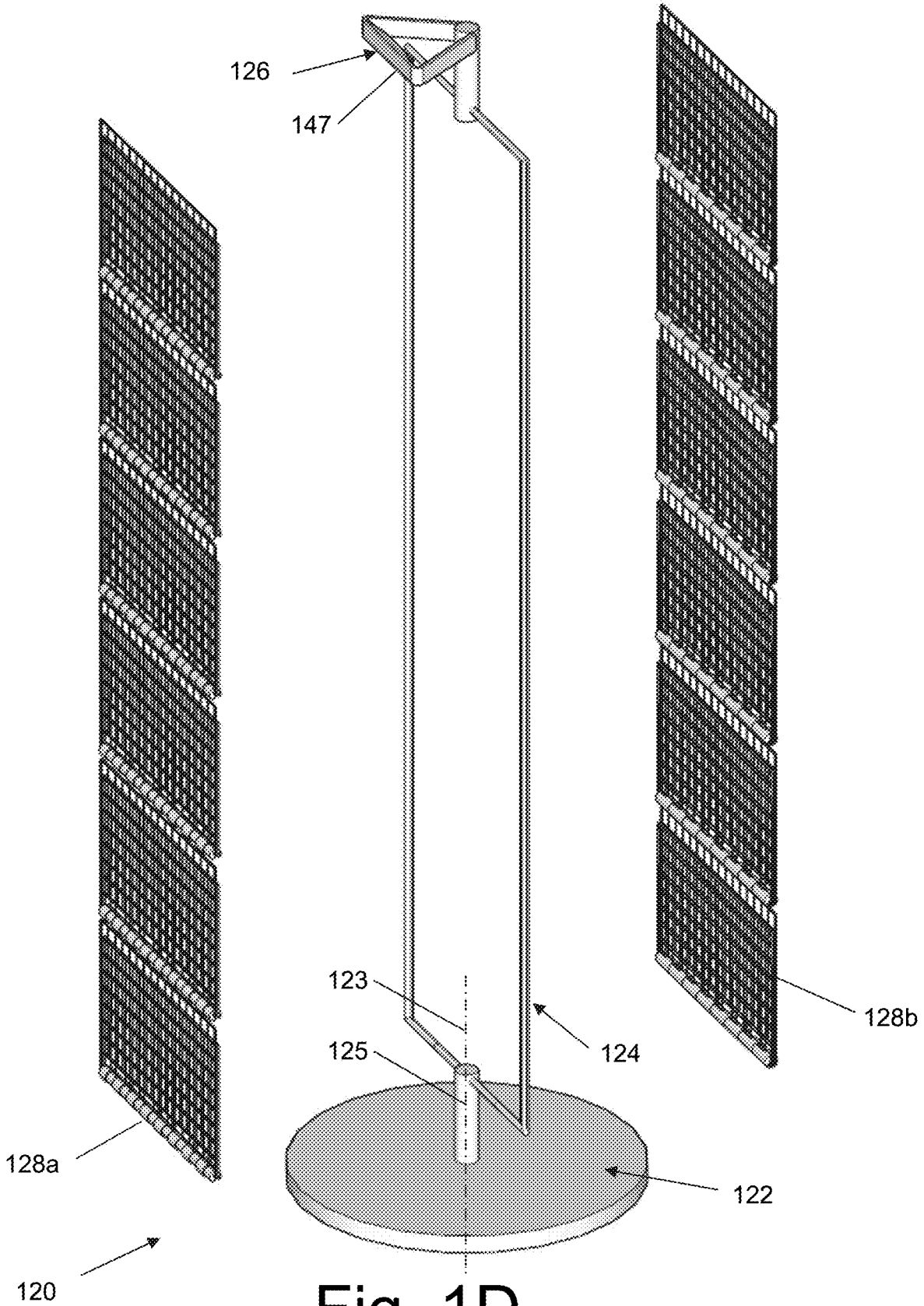
FIG. 1D is an exploded isometric view of the aspect illustrated in FIGS. 1A and 1B illustrating alternate features.
Figure 1E:
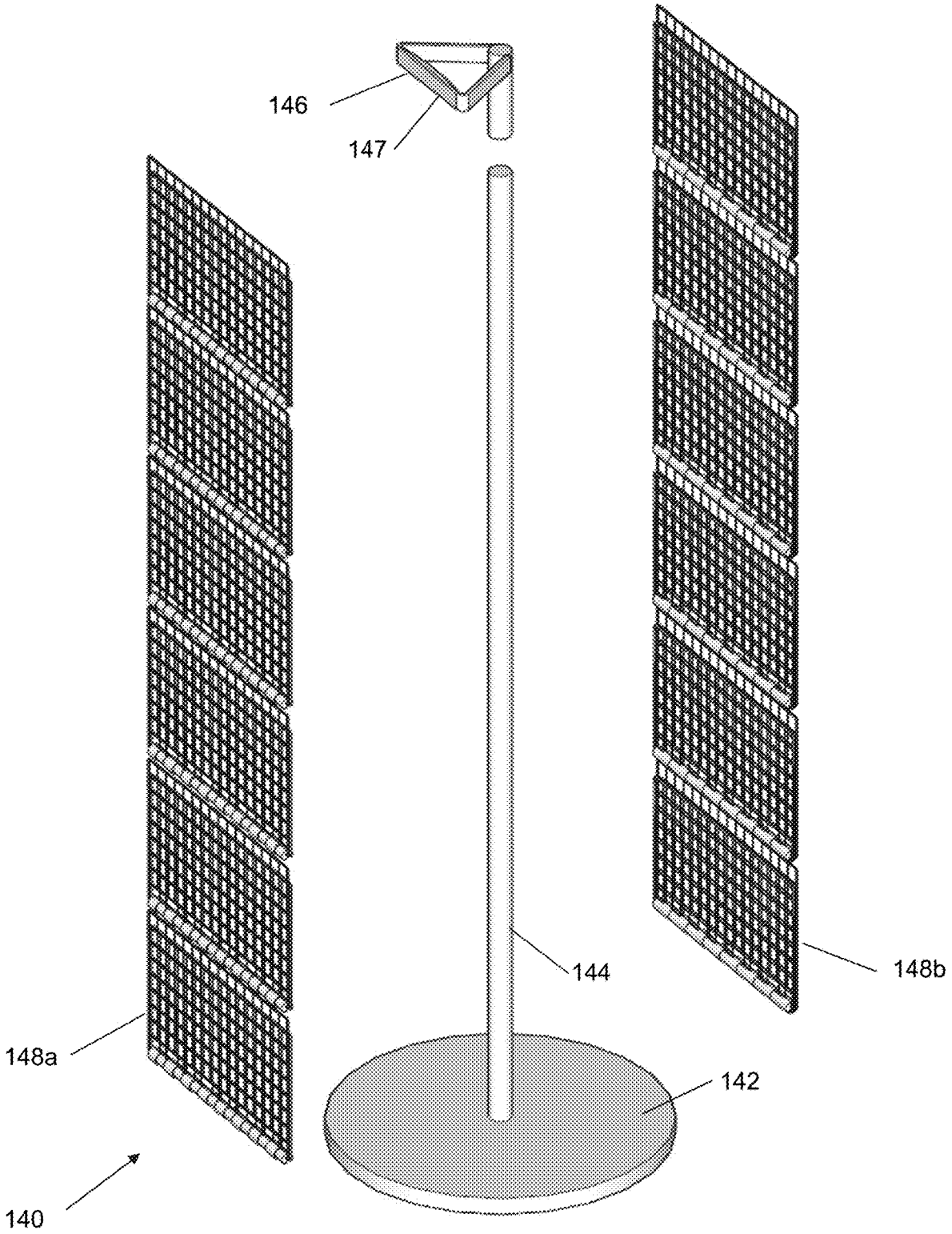
FIG. 1E is an exploded isometric view of the aspect illustrated in FIGS. 1A and 1B illustrating alternative features.

As illustrated in FIGS. 1D and 1E, the removable handle 126 or 146 may be "funnel shape" or triangular in shape and might have a cushioned surface (such as foam) on the lower surface of a center generally horizontal member 147 so that the system may be easily lifted or moved. In yet other embodiments, the cushioned surface could extend around the center member 147—which may be tubular in cross-section. In certain embodiments, the cushioned surface may be easily removable and may be available in a variety of colors or styles according to the preferences of the user. For instance, in one embodiment, the cushioned surface may have a strip of small hooks designed to engage a strip of small loops to fasten the cushioned surface around the center horizontal member 147. In yet, other embodiments, the cushioned surface may be permanently affixed to the generally horizontal member 147.

As illustrated in FIG. 1E, the removable handle 146 is in a horizontal position which allows the user to temporarily place a file or papers on the handle as discussed above. In contrast, in the embodiment illustrated by the system 100 of FIGS. 1A and 1B, the handle 106 is illustrated in a first or vertical position which allows the user to easily move the system 100.

In the embodiment 140, a handle 146 may be removably coupled to the vertical support, such as vertical support member 144 (FIG. 1E) allowing the user to choose a handle style that is aesthetically pleasing to the user. In certain embodiments, the removable handle 146 may have exterior threads (not shown) which screw into interior threads defined within an interior surface close to the top of a vertical support member, such as vertical support member 144. In other embodiments, the removable handle 146 may have interior threads (not shown) which couple with exterior threads defined within an exterior surface close to the top of a vertical support member, such as vertical support member 144.

Vertical Support

In certain embodiments, the vertical support 104 may have a vertical length of 14" to 40" inches such that the organizational system 100 may be positioned on the floor next to a desk or table. In other words, in certain embodiments, the height of the organizational system 100 is designed to provide accessibility for someone sitting at a desk. In yet other embodiments, the height of the organizational system 100 may be such that it fits under a conventional desk or table. Such a height would allow the organizational system 100 to be moved or positioned under a desk or table and thus moved out of the way under the desk or out of sight relatively easily. Although the vertical support member 104 may have a variety of configurations, in the embodiments illustrated in FIGS. 1A through 1C, the vertical support member 104 comprises a rectangular frame which couples to the plurality of shelf units 108 and the base 102 via two small support columns. Consequently, the vertical member 104 cannot rotate with respect to the base 102.

In other embodiments, such as illustrated by the system 120 of FIG. 1D, the rectangular frame 124 may couple to the base 122 via a single column 125 which allows the rectangular frame to rotate about the vertical or longitudinal axis 123 of the single column with respect to the base 122.

In certain embodiments, the rectangular frame 104 or 124 may have a plurality of horizontal and vertical cross members (not shown) to assist with structural stability and/or to serve as support rods for the shelf units. In such embodiments, such cross members may follow the foot print of the shelf units.

Figure 1F:
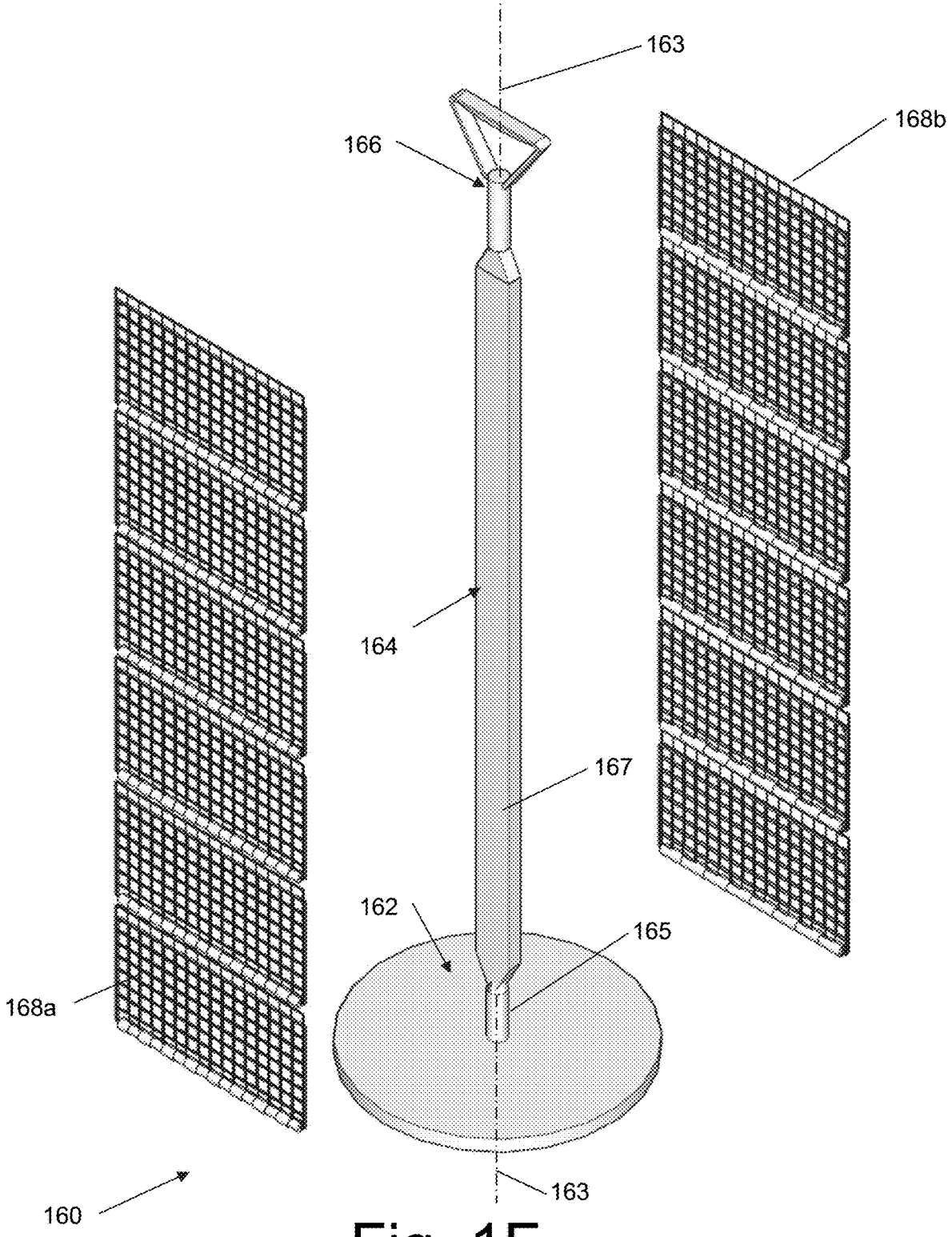
FIG. 1F is an exploded isometric view of the aspect illustrated in FIGS. 1A and 1B illustrating alternative features
Figure 4A:
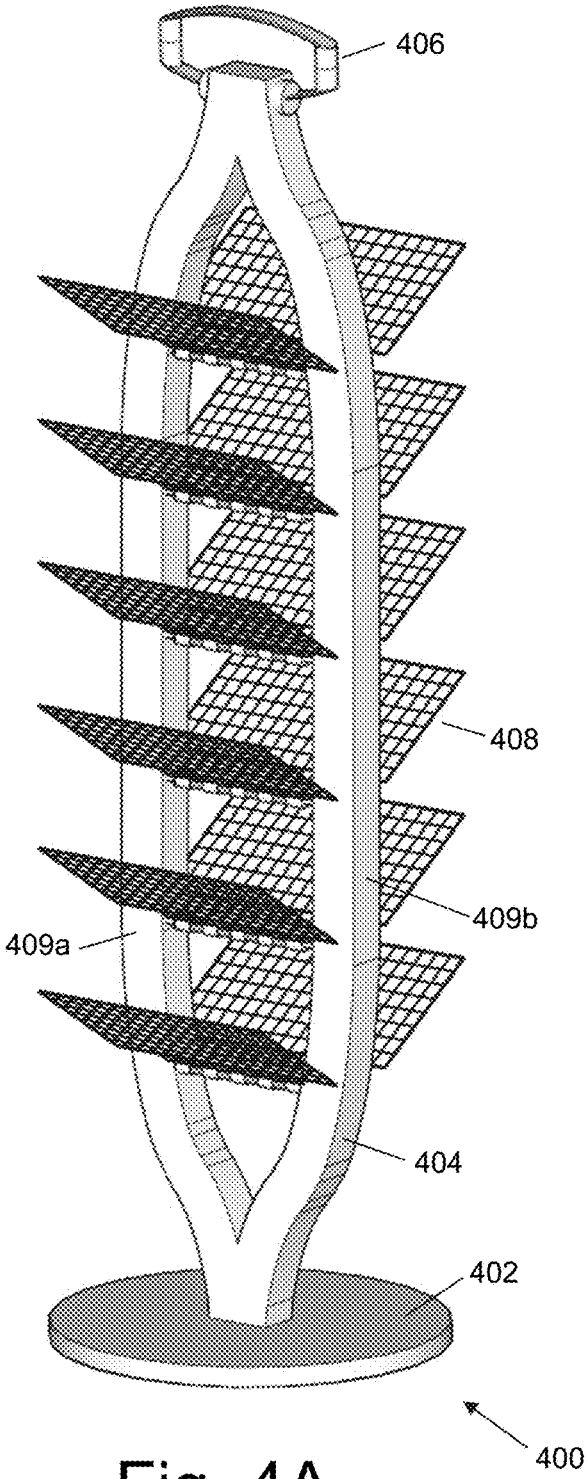
FIGS. 4A and 4B are isometric views illustrating one aspect of the present invention.
Figure 4B:
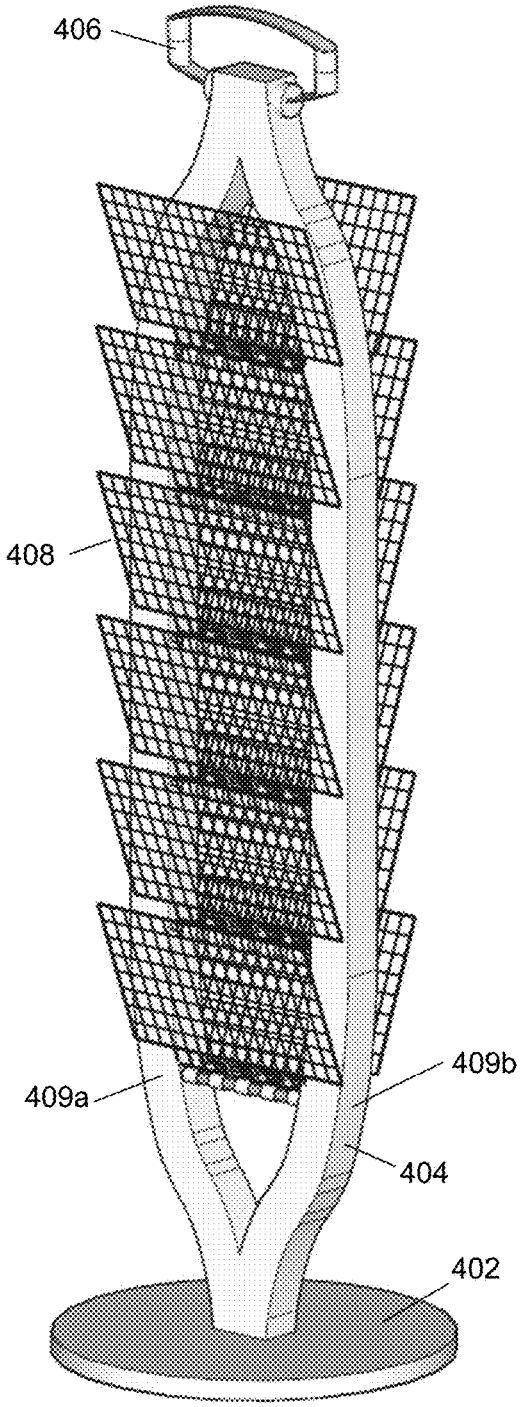

In certain embodiments, the vertical support may comprise a single vertical member (e.g., vertical support member 144 or 164 as illustrated in FIGS. 1E and 1F) or the vertical support can comprise two or more vertical members that merge at the top (to receive the handle) and at bottom (swivel at the base) as illustrated by vertical member 404 of FIGS. 4A and 4B.

Embodiments that use a single member to couple to the base, such as in the embodiment 140 illustrated in FIG. 1E, the vertical member 144 can rotate about its center or longitudinal axis with respect to the base 142.

In the embodiment 160 illustrated in FIG. 1F, a lower end of a vertical member 164 is a round column 165 which can rotate about its longitudinal axis 163 relative to the base 162. In this illustrative embodiment, the upper end of the round column 165 transitions to a relatively narrower rectangular section 167 to support one or two sets of shelf units 168*a* and 168*b* (which are illustrated in a collapsed position or configuration). The vertical support 164 illustrated in FIG. 1F is flattened to reduce the space between the backs (or vertical members) of the shelf members as will be explained below. At an upper end, the rectangular section may transition back to a round column to support the handle 166 (which is illustrated in a vertical position—as opposed to the handle 146 of FIG. 1E). The vertical support 164 may be adapted to couple to the removable handle 166 as discussed above.

Shelf Units

The shelf units, such as shelf units 108, may be coupled to the vertical support members in a variety of methods. In certain embodiments, the embodiments of the vertical support member may have a plurality of slots (e.g., rectangular apertures) formed on one or more exterior surfaces of the vertical support for supporting one or more individually removable shelf units (the shelf units then have a corresponding plurality of hooks or vertical projections positioned to correspond to one or more of the slots such that the shelf unit may couple to the slot in a conventional manner). In certain embodiments, the shelf units may be coupled individually to the vertical support. In yet other embodiments, shelf units may be coupled to the vertical support members as a group or set. In some instances, the shelf units extend laterally past the vertical support.

As illustrated in FIG. 1C (and as similarly illustrated in FIGS. 1D through 1F), the plurality of shelf units 108 may be separated into a first set of shelf units 108*a* positioned on one side of the vertical support 104 and a second set of shelf units 108*b* positioned on the opposing side of the vertical support 104.

In one embodiment, the set of shelf 108*a* units may be vertically coupled together—allowing a user to install the set 108*a* to the vertical member 104 using only a few connectors. In another embodiment, the shelf units within the set of shelf 108*a* units may be shipped or sold individually allowing a user to customize the vertical height between the individual shelf units. In such an embodiment, the shelf units may individually couple to the vertical member 104 via screws, clips, pegs or other devices known in the art.

Figure 1G:
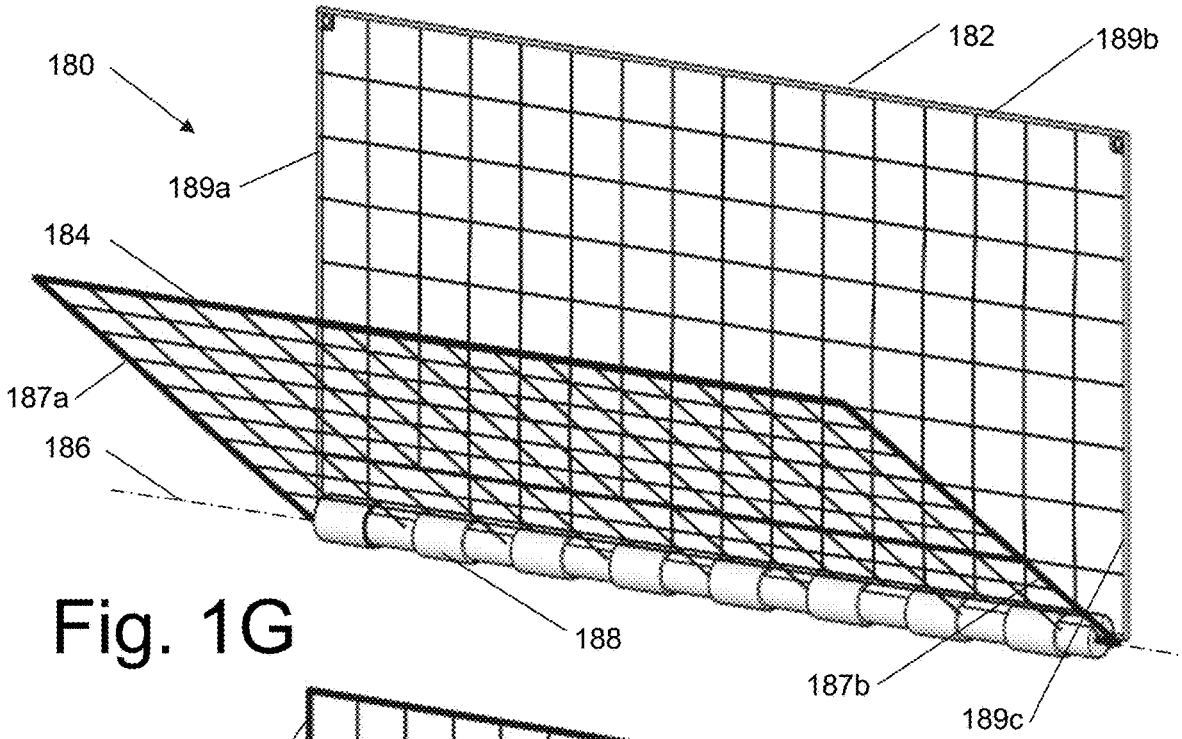
FIGS. 1G and 1H are detailed isometric views of a particular detail from the aspect illustrated in FIGS. 1A and 1B.
Figure 1H:
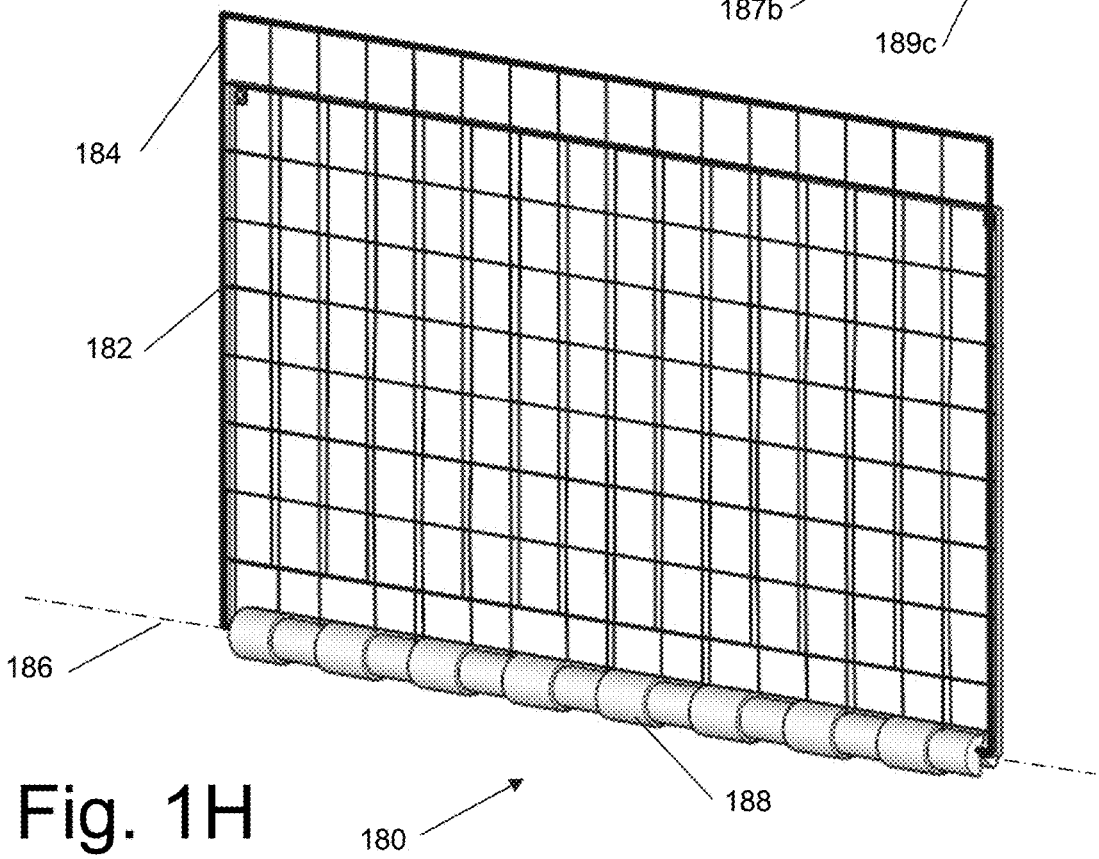

In the embodiments illustrated in FIGS. 1A through 1J, the individual shelf units (or sets of shelf units) are collapsible for ease of shipping and for storage (when the system is not in use). For instance, turning to FIG. 1G and FIG. 1H, there is illustrated one embodiment of a collapsible shelf unit 180. In FIG. 1G, the shelf unit 180 is in an open position. In FIG. 1H, the shelf unit 180 is in a closed position.

As illustrated in FIGS. 1G and 1H, the shelf unit 180 may comprise a vertical member 182 and a shelf member 184. The shelf member 184 may be able to rotate about a horizontal axis 186 which is proximal to the planar intersection of the vertical member 182 and the shelf member 184. As illustrated in FIG. 1G, the shelf unit 180 is open to a predetermined angle (e.g., about 35 degrees from the horizontal). In other embodiments, the shelf unit 180 may open to other predetermined angles (such as ranging from 60 degrees from the horizontal to zero degree or parallel with the horizontal).

In certain embodiments there may be a hinge 188 rotatably coupling the vertical member 182 to the shelf member 184. In certain embodiments, there may be one or more stops or angular support units which prevent the shelf member 184 from rotating past the predetermined angle relative to the vertical member 182. In the embodiment illustrated in FIGS. 1G and 1H, the angular support unit is integrated with the hinge 188. In other embodiments, the stop or angular support unit may be external to the hinge 188. For instance, the angular support unit may be one or more brace members (e.g. brace member 586*a* and 586*b* of FIG. 5C) which couples a top or side edge of the vertical member 182 to the exterior most or top edge of the shelf member 184. A hinge (e.g., 588*a* and 588*b*) in the brace member allows the brace member to fold when the shelf unit is in a closed position and to extend to support the shelf member 184 when the shelf unit is in an open position.

In yet other embodiments, the angular support unit may be one or more brace or tension members which are rotatably coupled to the vertical member 182 and slidingly coupled to the shelf member 184 such that when the shelf unit is moved from a a closed position to an open position (or vice versa) the tension member slides relative to the side edges 187*a* and 187*b* of shelf member to allow the shelf member to rotate towards the vertical member 182. When the shelf unit is an open position, the tension member slides in the opposite direction to allow the shelf member 184 to rotate away from the vertical member 182 until the shelf member is rotated to the predetermined angle (discussed above).

In yet further embodiments, the angular support unit may be one or more brace or tension members which are slidingly coupled to the vertical member 182 and rotatably coupled to the shelf member 184 such that when the shelf unit is in a closed position, the tension member slides inward laterally relative to the vertical member 182 to allow the shelf member 184 to rotate towards the vertical member 182. When the shelf unit is an open position, the tension member slides in the opposite direction to allow the shelf member 184 to rotate away from the vertical member 182 until the shelf member is rotated to the predetermined angle (discussed above).

As illustrated in FIGS. 1G and 1H, the vertical member 182 and/or the shelf member 184 may be made of a wire mesh with thicker support members around the edges and to coupled to the hinge 188. In other embodiments, the vertical member 182 and/or the shelf member 184 may be made from wood (e.g., bamboo), a laminated wood, bent plywood, metal (such as polished aluminum), laser cut metal (to reduce weight), plastic, a composite material having a leather or faux leather exterior or a flexible material, such as canvas, leather or faux leather. When the vertical member 182 and the shelf member 184 are made from a flexible material, there may be a metal frame or thicker members supporting the flexible material. Such frame members may be similar to the frame members 189*a*-189*d* (See FIG. 1*i* for frame member 189*d*) which are illustrated as part of the vertical member 182.

Figure 1I:
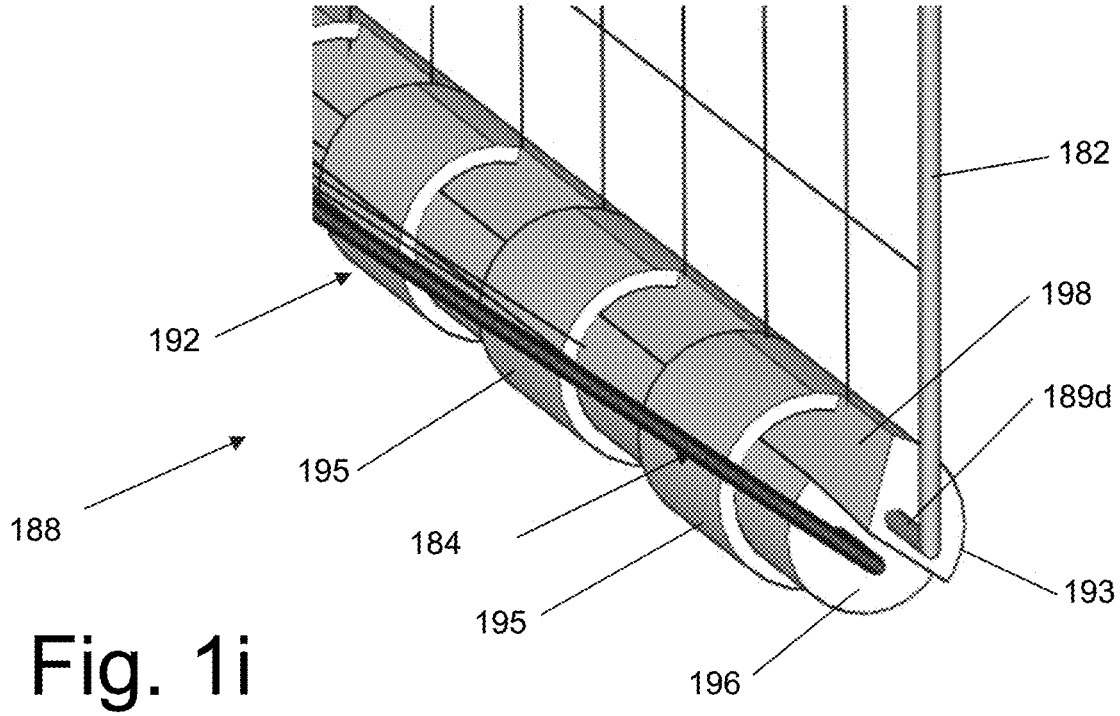
FIGS. 1*i* and 1J are detailed isometric views of a particular detail from the aspect illustrated in FIGS. 1A and 1B.
Figure 1J:
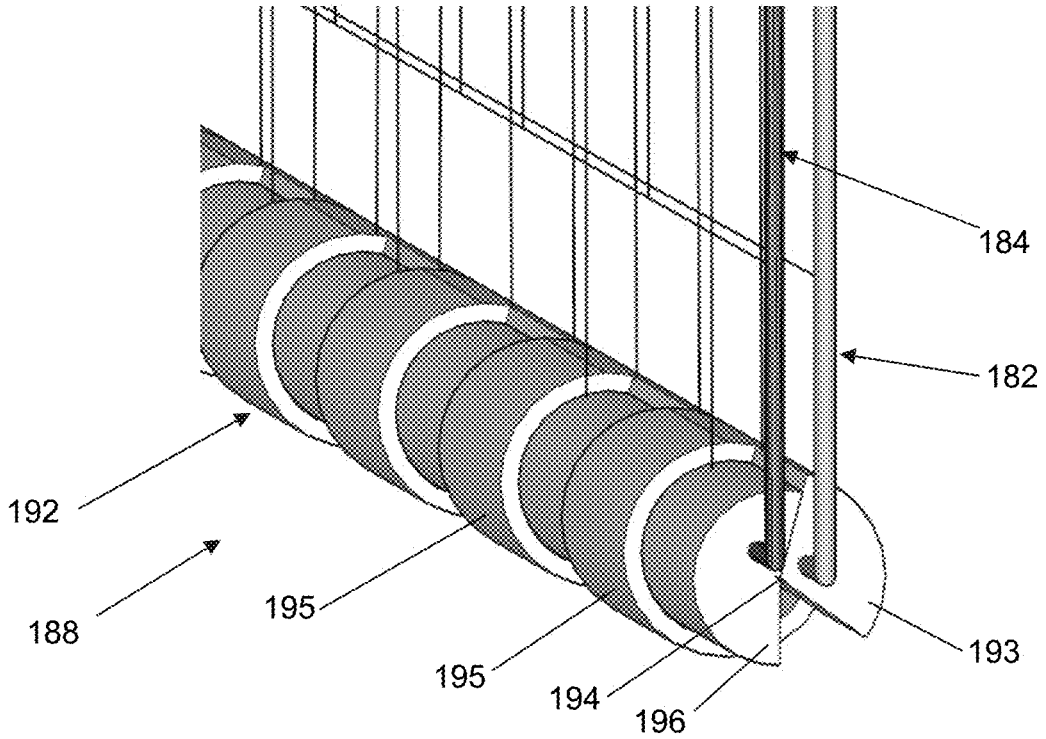

Turning now to FIG. 1*i* and FIG. 1J, there is an isometric detailed view of an end of one embodiment of a self stopping hinge 188. As illustrated, the hinge 188 comprises an exterior member 192 which is coupled to the vertical member 182 via the frame of the vertical member 182. The exterior member 192 comprises a longitudinal portion 193 having a "pie shape" cross sectional shape and at regular intervals, partial tubular structures or knuckles 195 extend out from the edges of the longitudinal member or portion 193 of the exterior member 192. As illustrated, the exterior member 192 has a "center" or rotational axis which is located along the apex 194 of the pie shape longitudinal member.

An interior member or pin 196 having a partial cylindrical shape and a cross-sectional shape a half of a circular shape (in other words, 180 degrees or greater) is sized to fit and rotate within the knuckles 195 of the exterior member 192. The internal member 196 couples to the shelf member 184 via a frame member as discussed above.

FIG. 1J illustrates the shelf unit 180 in a closed position. In other words the vertical member 182 and the shelf member 184 are generally parallel to each other (for instance see FIG. 1B). To open the shelf unit 180, the shelf member 184 may be pulled down which forces the pin 196 to rotate about the apex 194 of the exterior member 192 until one longitudinal face of the pin 196 abuts an interior face of the exterior member 192. At that point, the pin 196 cannot rotate further. Consequently, the shelf member 184 will not rotate further because the exterior member 192 acts as a rotational stop. The angle of the interior face of the pin 196 relative to the apex 194 determines the angle that the shelf member 184 will rotate relative to the vertical member 182.

When the user wishes to store the system, the use may push upwards against the shelf member 184, which in turn will cause the pin 196 to rotate about the apex 194 until the pin abuts the second or top face 198 of the exterior member 192 as illustrated in FIG. 1J. Thus, the top face 198 of the exterior member 192 acts as a rotational stop. In certain embodiments, the shelf member 184 is held in place due to the friction between the exterior round surface of the pin 196 and interior surfaces of the knuckles 195.

The embodiment of the self stopping hinge 188 illustrated in FIGS. 1*i* and 1J contemplates a structural frame mainly comprising an exterior frame, such as frame members 189*a* through 189*d* discussed above in reference to FIGS. 1G and 1H.

Figure 2A:
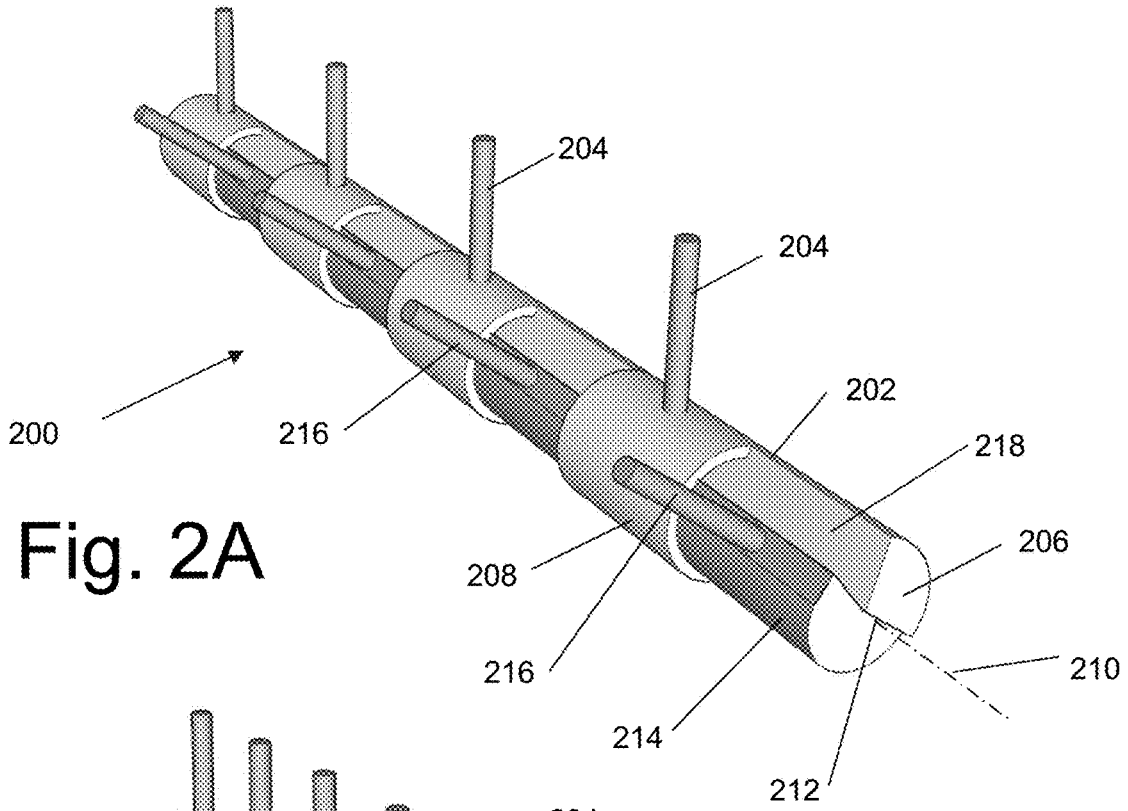
FIGS. 2A and 2B are detailed isometric views of a particular detail which could be used with the aspect illustrated in FIGS. 1A and 1B.
Figure 2B:
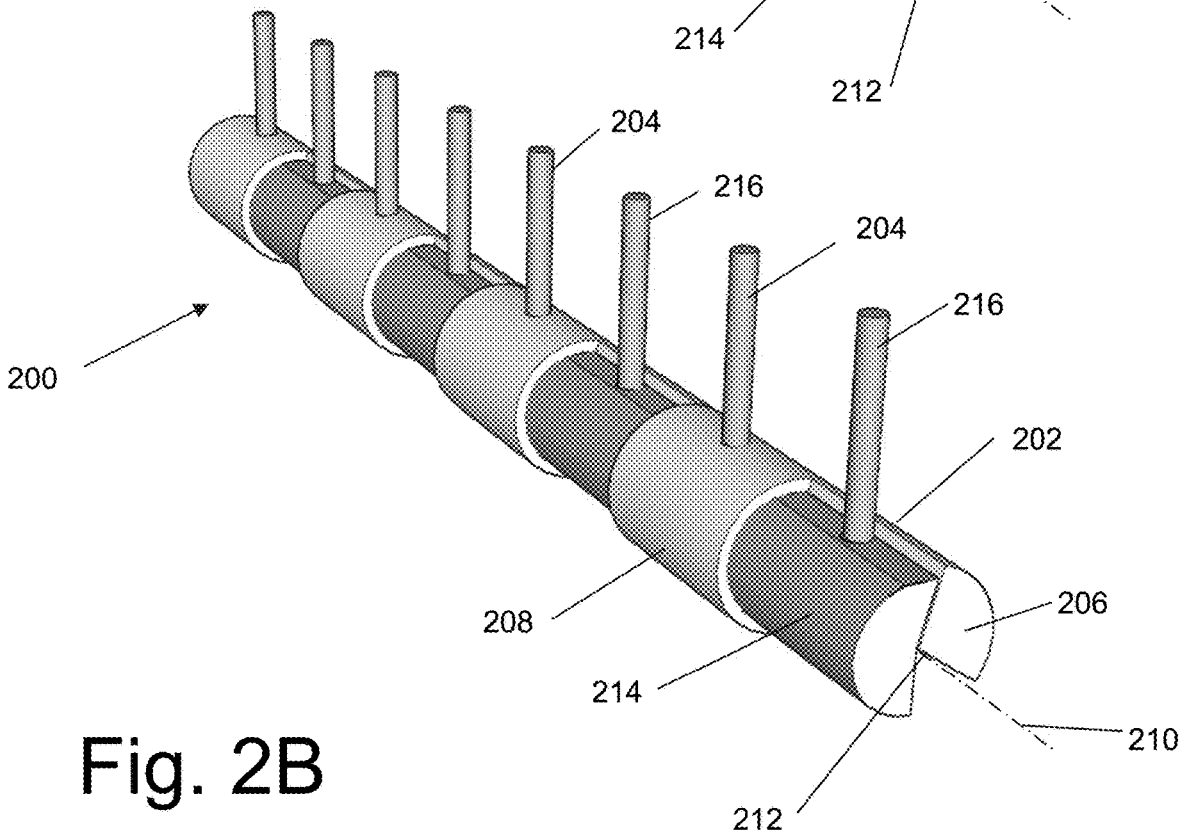

Turning now to FIG. 2A and FIG. 2B, there is an isometric detailed view of an end of one embodiment of a self stopping hinge 200 which may be used with embodiments of the organization systems discussed in this application having interior frame members (such as frame members 204 and 216). As illustrated, the hinge 200 comprises an exterior member 202 which is fixedly coupled to a plurality of vertical frame members or supports 204 that are part of or can be coupled to part of a vertical member, such as vertical member 182 (FIG. 1G) of a shelf unit, for instance, of the system 100. The exterior member 202 comprises a longitudinal portion 206 having a "pie shape" cross sectional shape. At regular intervals round partial tubular structures or knuckles 208 extend from edges along the longitudinal portion 206. As illustrated, the exterior member 202 has a "center" or rotational axis 210 which is positioned along an apex 212 of the pie shape longitudinal portion 206.

An interior member or pin 214 having a partial cylindrical shape and a cross-sectional pie shape that is roughly half of a circular shape (in other words, 180 degrees or greater) is sized to fit and rotate within the knuckles 208 of the exterior member 202. The pin 214 couples to a plurality of shelf framing members or supports 216 as illustrated in FIGS. 2A and 2B.

FIG. 2B illustrates the hinge 200 in a closed position. In other words the vertical supports 204 and the shelf supports 216 are generally parallel to each other. To open the hinge 200, the shelf member 184 may be pulled down, which in turn, rotates the shelf framing members or supports which forces the pin 214 to rotate about the rotational axis 210 at the apex 212 of the exterior member 202 until one longitudinal face of the pin 214 abuts an interior face of the exterior member 202. At that point the pin 214 cannot rotate further. So, the interior face of the exterior member 202 acts as a stop. Consequently, the shelf framing members or shelf supports 216 (and the shelf member 184) will not rotate further. The angle of the interior face of the exterior member 202 relative to the apex 212 determines the angle of the shelf member 184 relative to the vertical member 182 when the shelf member 184 is in an open configuration or position.

When the user wishes to store the system, such as the system 100, the user may push up against or rotate the shelf member 184, which in turn will cause the pin 214 to rotate about the apex 212 until the pin abuts the second or top face 218 of the exterior member 202 as illustrated in FIG. 2B. Thus, the top face 218 of the exterior member 202 acts as a rotational stop. In certain embodiments, the shelf member 184 is held in place due to the friction between the exterior round surface of the pin 214 and interior surfaces of the knuckles 208.

In embodiments, where the angular support unit is a brace or tension member, the hinge (not shown) allowing rotation between the vertical member and the shelf member at their intersection may be accomplished by using a plurality of tubular members encasing the "intersecting" support members of the vertical member and the shelf member as is typical of a piano or butt hinge commonly known in the art of hinges.

Figure 1K:
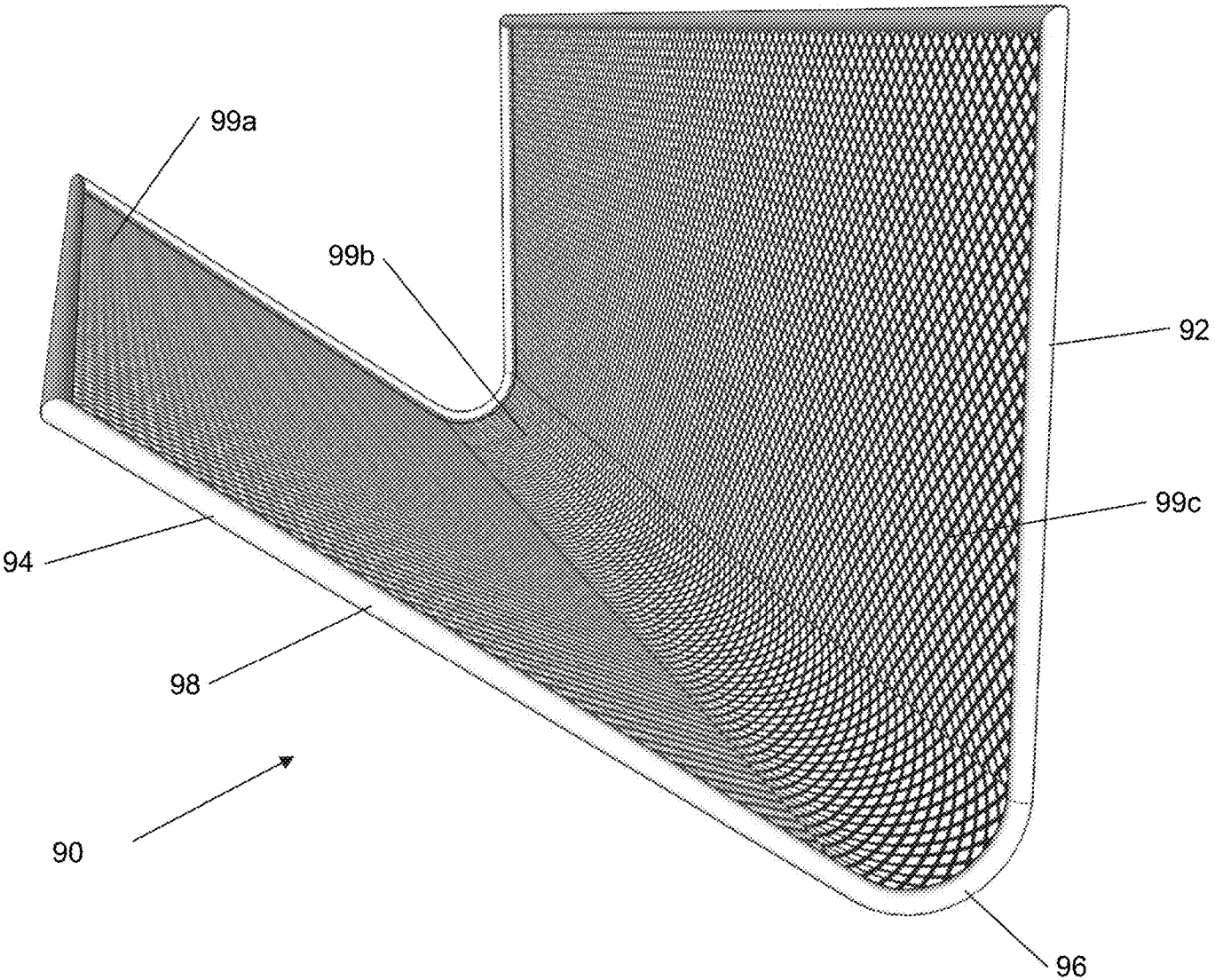
FIG. 1K is a detailed isometric view of a particular alternative detail which could be used with the aspect illustrated in FIGS. 1A and 1B.

FIG. 1K illustrates a shelf unit 90 comprising a vertical member 92 and fixed shelf member 94 (i.e. a non-rotatable member). In this embodiment of the shelf unit, the vertical member 92 may be joined to the shelf member 94 by a curved joining portion 96. The amount of curve of the curved joining portion (i.e., the radius of the curve may depend on either the manufacturing considerations, practical uses, or aesthetic considerations). By way of example, the shelf unit 90 may comprise an exterior frame 98 surrounding the exterior edges of the vertical member 92, the shelf member 94, and the curved member 96. The exterior frame 98 may be made from a tubular structure and formed, for example from metal. The interior portions 99*a* through 99*c* of the vertical member 92, the curved member 96, and the shelf member 94, respectively, may be made from a stiff wire mesh material, a laser cut metal or plastic.

OTHER EMBODIMENTS

Additional embodiments are illustrated and discussed below. For brevity and clarity, a description of those parts which are identical or similar to those described in connection with the embodiments illustrated above will not be repeated here. Reference should be made to the foregoing paragraphs with the following description to arrive at a complete understanding of the following embodiments. Please note that any combination of any component of the various embodiments throughout this application may be combined and used with the components of other embodiments as represented in the following and future claims.

Figure 3A:
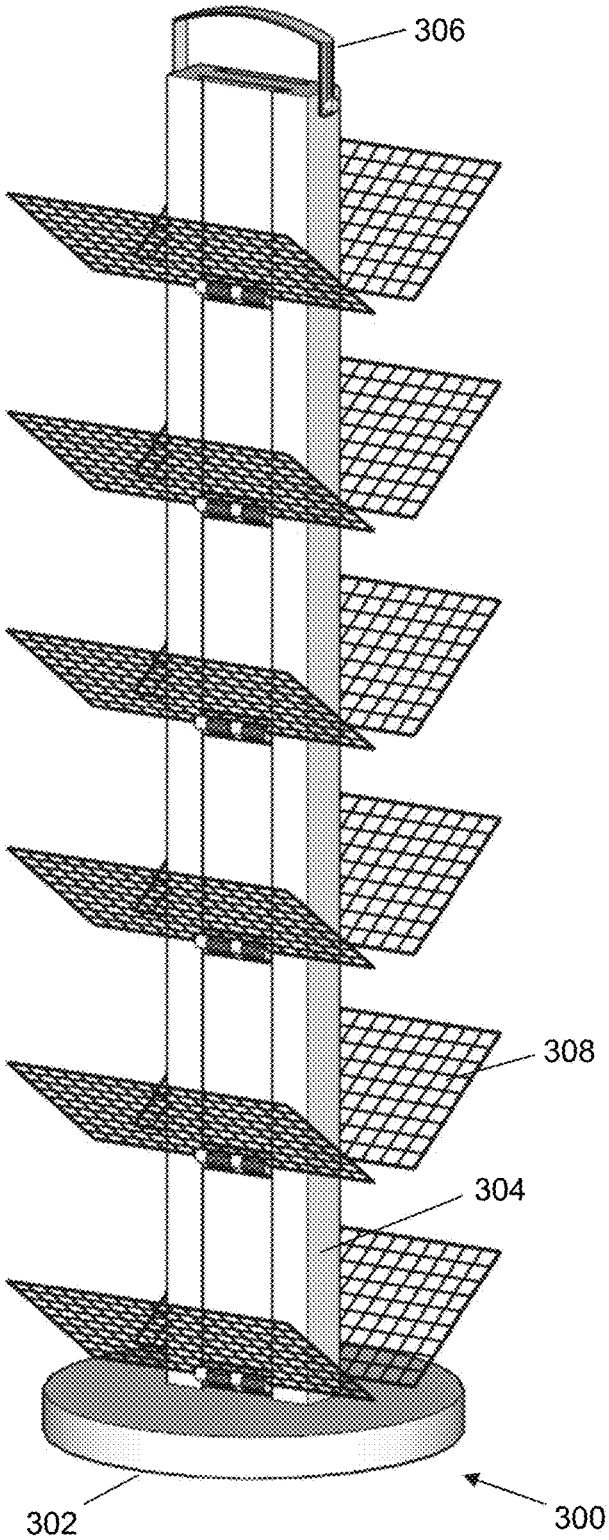
FIGS. 3A and 3B are isometric views illustrating one aspect of the present invention.
Figure 3B:
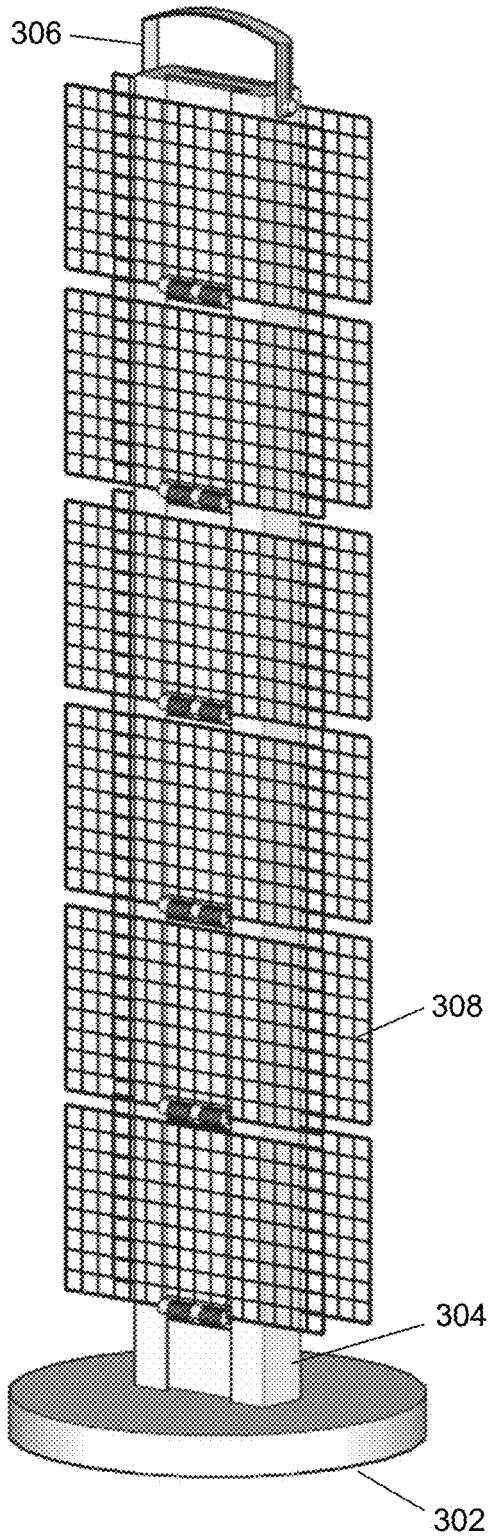

Turning now to FIGS. 3A and 3B, there is an organizational system 300 having a base 302, a vertical support 304, and a handle 306. The vertical support may be coupled to a plurality of shelf units 308. In the illustrative embodiment of FIG. 3A, the plurality of shelf units 308 are in an open configuration. In the illustrative embodiment of FIG. 3B, the plurality of shelf units 308 are in a closed configuration.

Figure 3C:
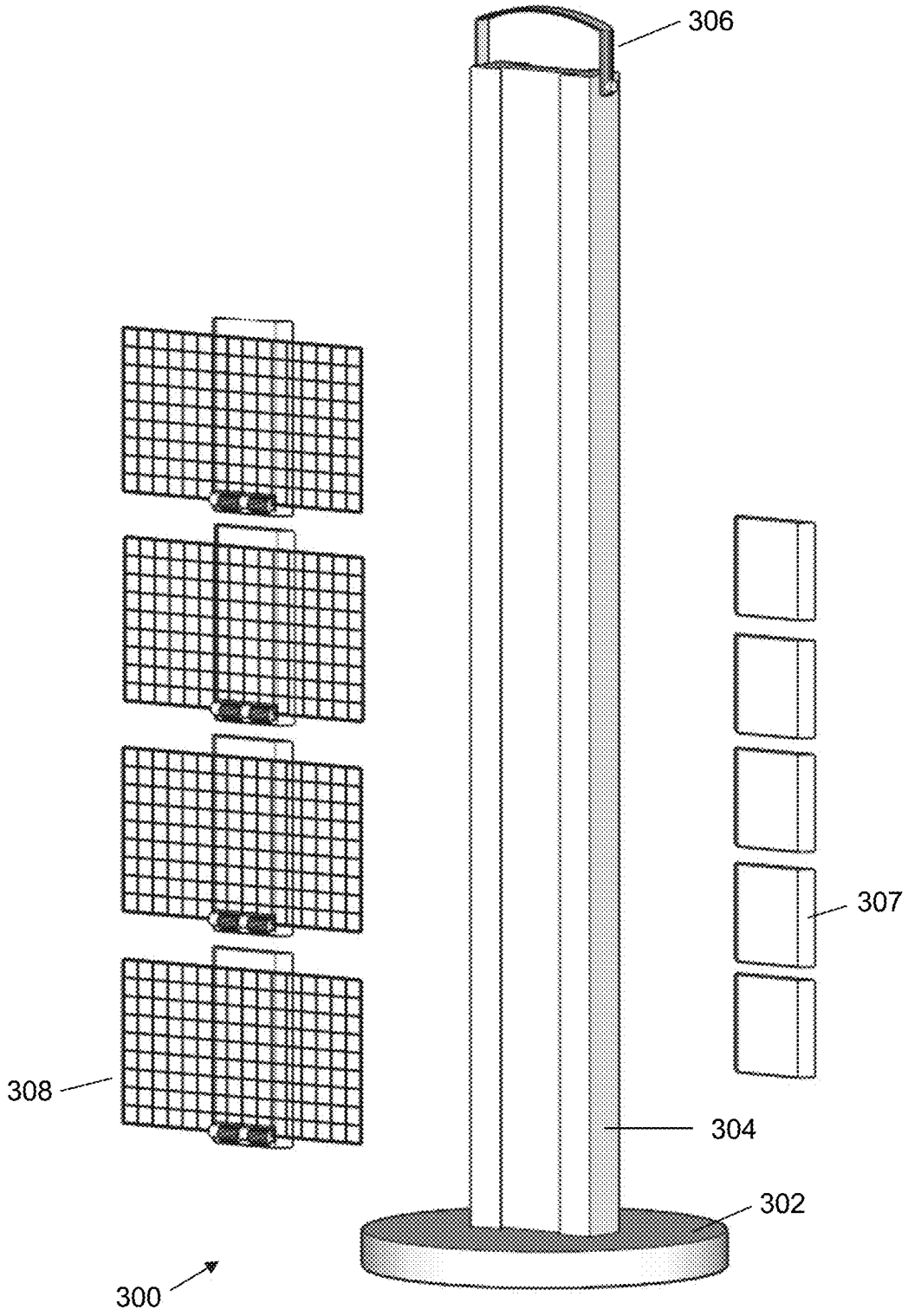
FIG. 3C is an exploded isometric view of the aspect illustrated in FIGS. 3A and 3B in an unassembled form.

In certain embodiments, the organization system 300 may be shipped or sold as a modular kit as illustrated in FIG. 3C. FIG. 3C illustrates a plurality of shelf units 308, a vertical support 304 and a plurality of spacers 307. The upper portion of the vertical support 304 couples to the handle 306 which may be rotatable about an axis lateral to a longitudinal axis of the vertical support member. In certain embodiments, the handle 306 may be removable and couple to the top of the vertical support via a threaded stud or a threaded aperture.

The lower portion of the vertical support 304 may be either rotatably or fixedly coupled to the base 302. As illustrated in FIG. 3C, the vertical support 304 may have a vertical slot defined in one or more faces of the vertical support. The spacers 307 and a portion of the shelf units 308 are sized and shaped to fit within the vertical slot. The vertical slot is shaped in a dovetail fashion to provide lateral support to the spacers and/or shelf units 308.

Figure 3D:
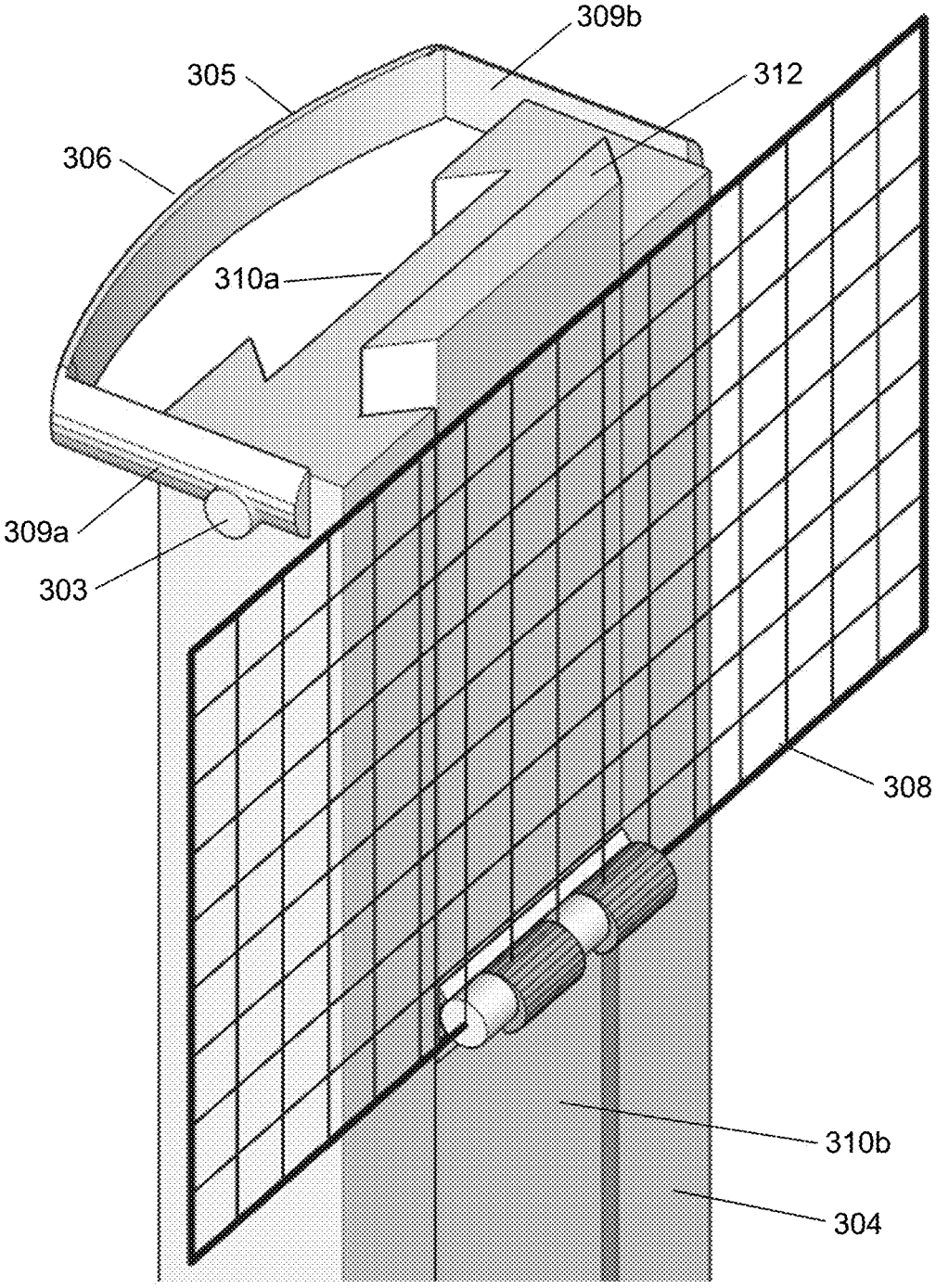
FIG. 3D is a detailed isometric view of a particular detail from the aspect illustrated in FIGS. 3A and 3B.

FIG. 3D is a detailed view of the top of the vertical support 304 illustrating a closed shelf unit 308 partially within a first vertical slot. As illustrated in FIG. 3D, the handle 306 is rotated approximately 90 degrees from a vertical or longitudinal axis. Although the handle 306 is illustrated as coupled to the vertical support 304, in yet other embodiments, the handle 306 may be removably coupled and sold independently or as a customized option. As illustrated, in FIGS. 3A through 3D, the handle 306 couples to the vertical support 304 via a pin 303 which allows the handle 306 to rotate with respect to the vertical support 304. Stops may be defined within the vertical support to keep an edge of a generally lateral member 305 in a generally horizontal position with respect to the top of the vertical support 304, thereby creating a level support for the placement of files or papers as described above. In yet other embodiments, a generally lateral handle member 305 may be wider than the vertical members 309*a* and 309*b* so as to create a level support.

As illustrated, the vertical support 304 has a first vertical slot 310*a* for receiving a coupling portion 312 of the shelf unit 308 or a spacer 307. A second vertical slot 310*b* may defined on an opposing side of the vertical support 304. Thus, the spacers 307 and shelf units 308 may be dropped or slid into the first or second vertical slots. As illustrated, the coupling portion 312 of a shelf unit 308 is partially disposed within the slot 310*b*. The end user can interchange the number of shelf units 308 and spacers 307 which allows the user to customize the number of shelf units and the spacing of the shelf units used by the system 300. Although the coupling portion 312 is illustrated to be "taller" than the width of the shelf unit 308, in other embodiments the coupling portion 312 may be shorter than the width of the shelf unit 308 to allow more shelves to be coupled to the vertical support 304.

Figure 3E:
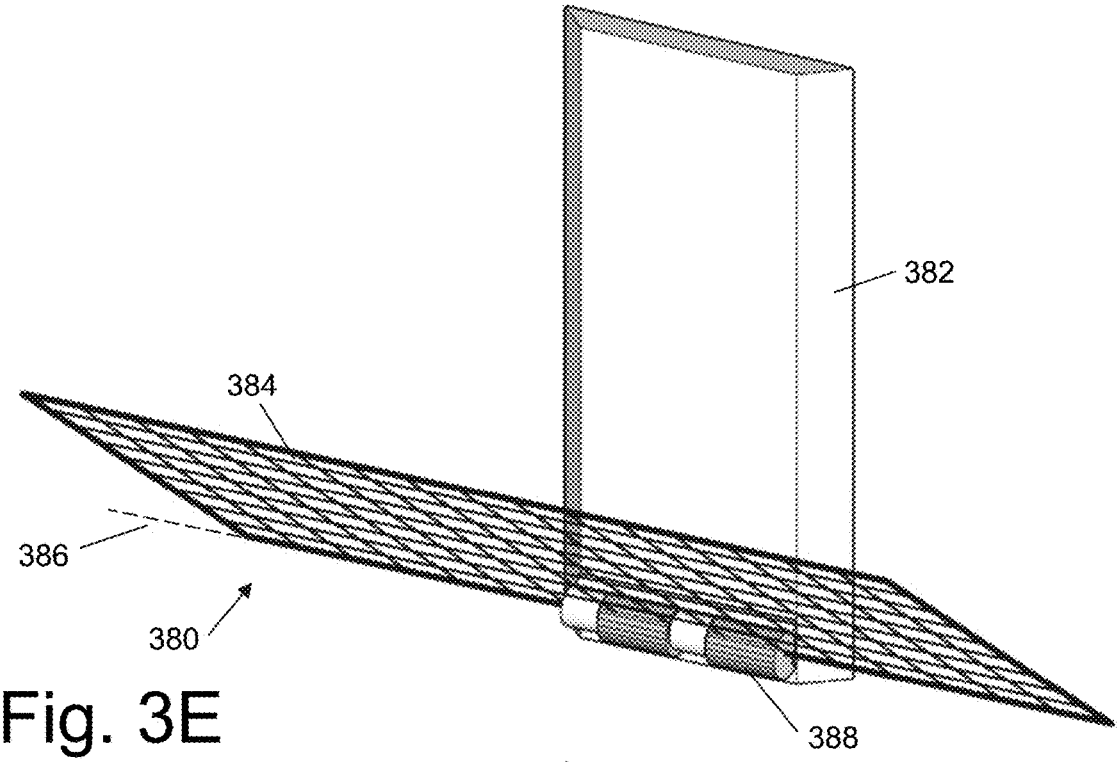
FIGS. 3E and 3F are detailed isometric views of a particular detail from the aspect illustrated in FIGS. 3A and 3B.
Figure 3F:
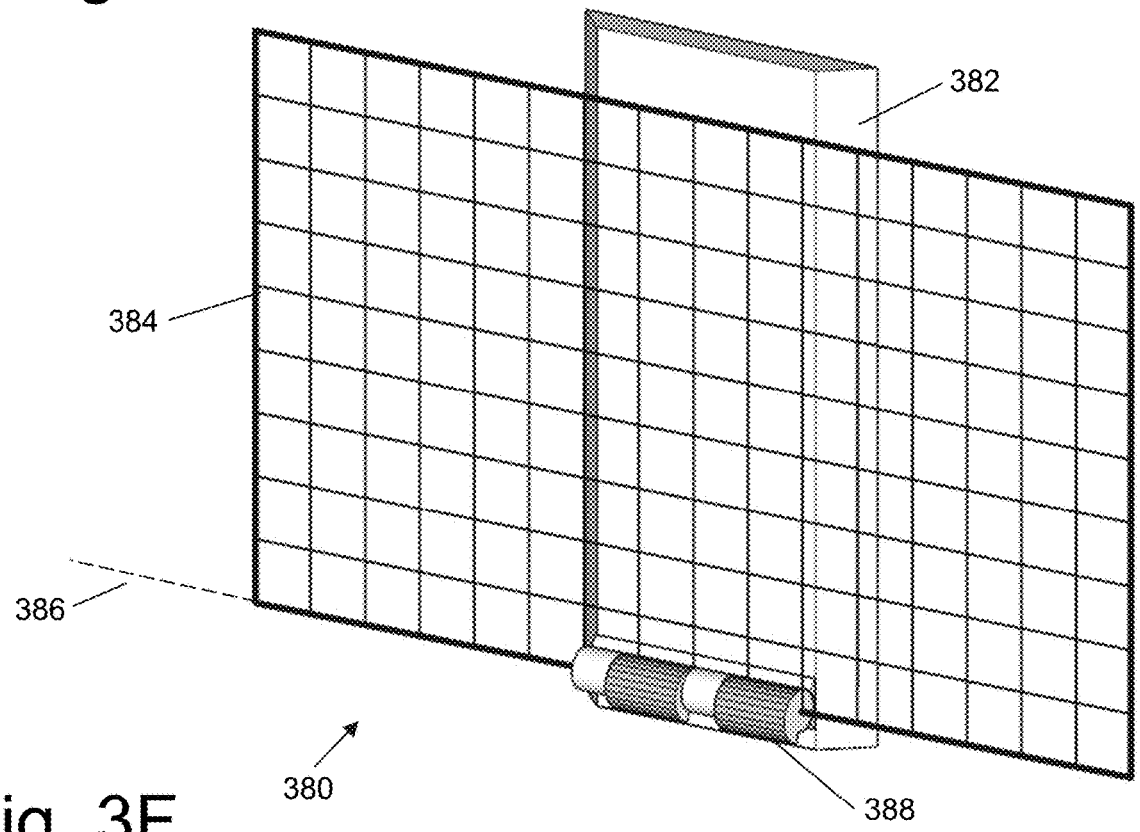

Turning to FIG. 3E and FIG. 3F, there is illustrated one embodiment of a collapsible shelf unit 380 (which is similar to the shelf unit 308 discussed above). In FIG. 3E, the shelf unit 380 is rotatable is illustrated in an open position. In FIG. 3F, the shelf unit 380 is in a closed position. As illustrated, the shelf unit 380 may comprise a vertical or coupling member 382 and a shelf member 384. The shelf member 384 may be able to rotate about a horizontal or lateral axis 386 which, in certain embodiments, is proximal to a lower end of the coupling member 382. As illustrated in FIG. 3E, the shelf unit 380 is open to a predetermined angle (e.g., about 65 degrees from vertical). In other embodiments, the shelf unit 380 may open to other predetermined angles (such as ranging from 10 degrees from vertical to 90 degrees from vertical—parallel with the horizontal).

In other embodiments (not shown), the shelf member 384 is fixedly coupled to a vertical member or the coupling member 382 and thus cannot rotate.

In certain embodiments, there may be a self stopping hinge unit or angular support unit 388 rotatably coupling the vertical member 382 to the shelf member 384. In certain embodiments, the self stopping hinge 388 prevents the shelf member 384 from rotating past the predetermined angle relative to the vertical coupling member 382.

As illustrated in FIGS. 3E and 3F, the shelf member 384 may be made of a wire mesh with a frame or thicker support members around the edges and/or coupled to the hinge 388. In other embodiments, the shelf member 384 may be made from wood (e.g., bamboo), a laminated wood, metal (such as polished aluminum), laser cut metal, plastic, or a flexible material, such as canvas, leather or faux leather. When the shelf member 384 is made from a flexible material, there may be a metal frame of thicker members supporting the flexible material.

The vertical coupling member 382 may be made from wood (e.g., bamboo), a laminated wood, metal (such as polished aluminum), plastic, or any material which may structurally support vertical loads from shelf units above and lateral loads of the shelf member 384.

Figure 3G:
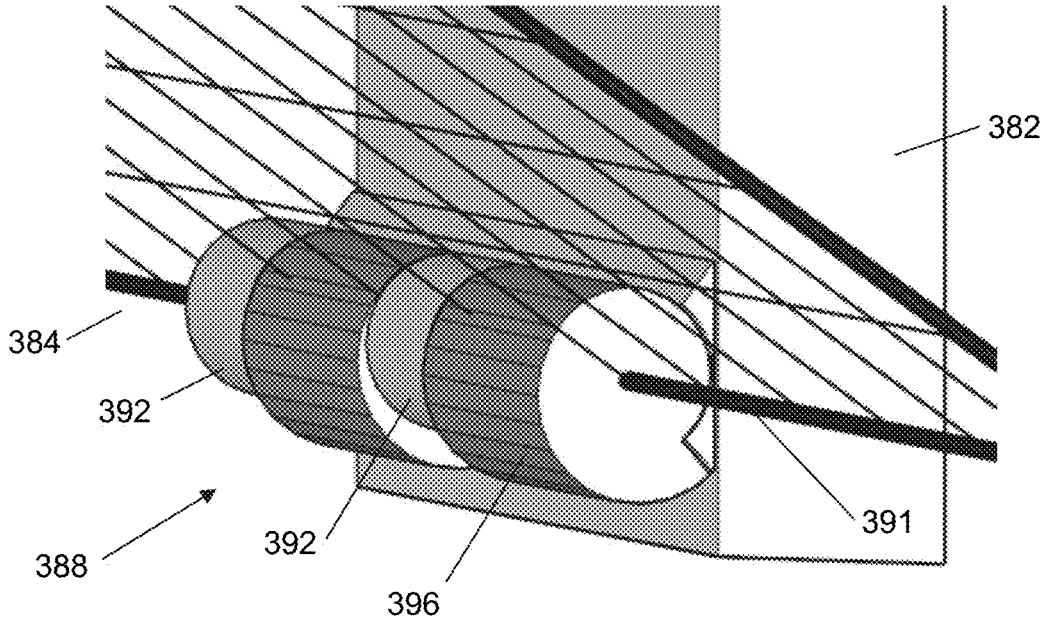
FIGS. 3G and 3H are detailed isometric views of a particular detail from the aspect illustrated in FIGS. 3A and 3B.
Figure 3H:
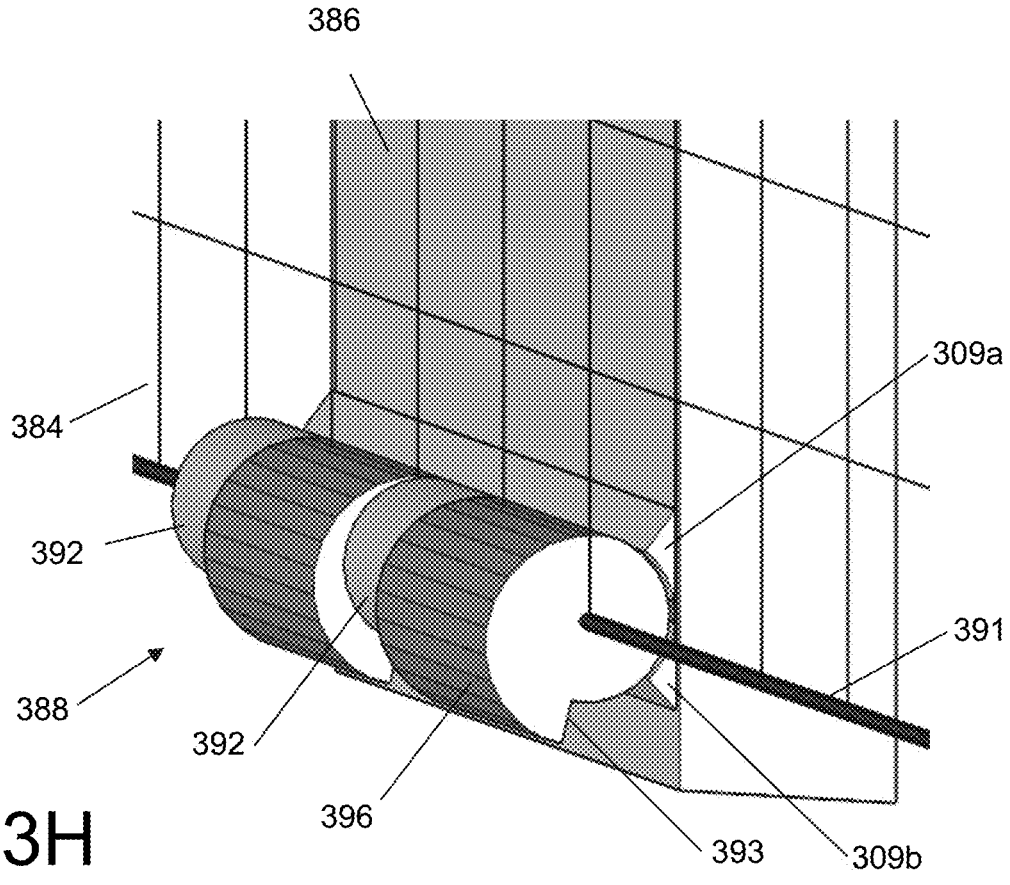

Turning now to FIG. 3G and FIG. 3H, there is an isometric detailed view of a lower end of one embodiment of the shelf unit 380 which illustrates the self stopping hinge 388. As illustrated, the self stopping hinge 388 comprises a partially circular groove defined by a first generally triangular projection 390*a* and a second triangular projection 390*b* which is formed on (or coupled to) the face of the vertical member 382. The first and second triangular projections each have a curved surface and a flat surface opposing the curved surface. The first and second triangular projections are positioned such that their respective curved surfaces face each other. At one or more intervals tubular structures or knuckles 392 extend from the first and second triangular projections. The knuckles 392 have an aperture (not shown) sized to allow a frame member 391 of the shelf member 384 to act as a pin and thus to freely rotate within the aperture.

The frame member 391 fixedly couples to at least one cam-shaped member 396 positioned along a common longitudinal axis of the apertures of the knuckles 392. The cam shaped members 396 have a generally circular cross-section except that a cam section face 393 abruptly projects radially from the center of the circular section on one end. The cam shaped section follows a curve such that it tangentially merges into the exterior circular surface at approximately 180 degrees from the projected face 393. The longitudinal axis of the cam-shaped member 396 coincides with the frame member 391 and the center axis of the knuckles 392 such that the cam-shaped member 396 and the frame member 391 have the same rotational axis.

FIG. 3H illustrates the shelf unit 380 in a closed position. In other words the vertical member 382 and the shelf member 384 are generally parallel to each other. To open the shelf unit 380, the shelf member 384 may be pulled or rotated down which forces the cam shaped member 396 to rotate about its longitudinal axis until the projected face 393 abuts a flat face of the lower triangular projection 390*b*. At that point the cam shaped member 396 and thus, the shelf unit 380 cannot rotate further. The angle of the triangular projection relative to the vertical surface of the vertical member 382 determines the angle of the shelf member 384 relative to the vertical member 382.

Figure 3I:
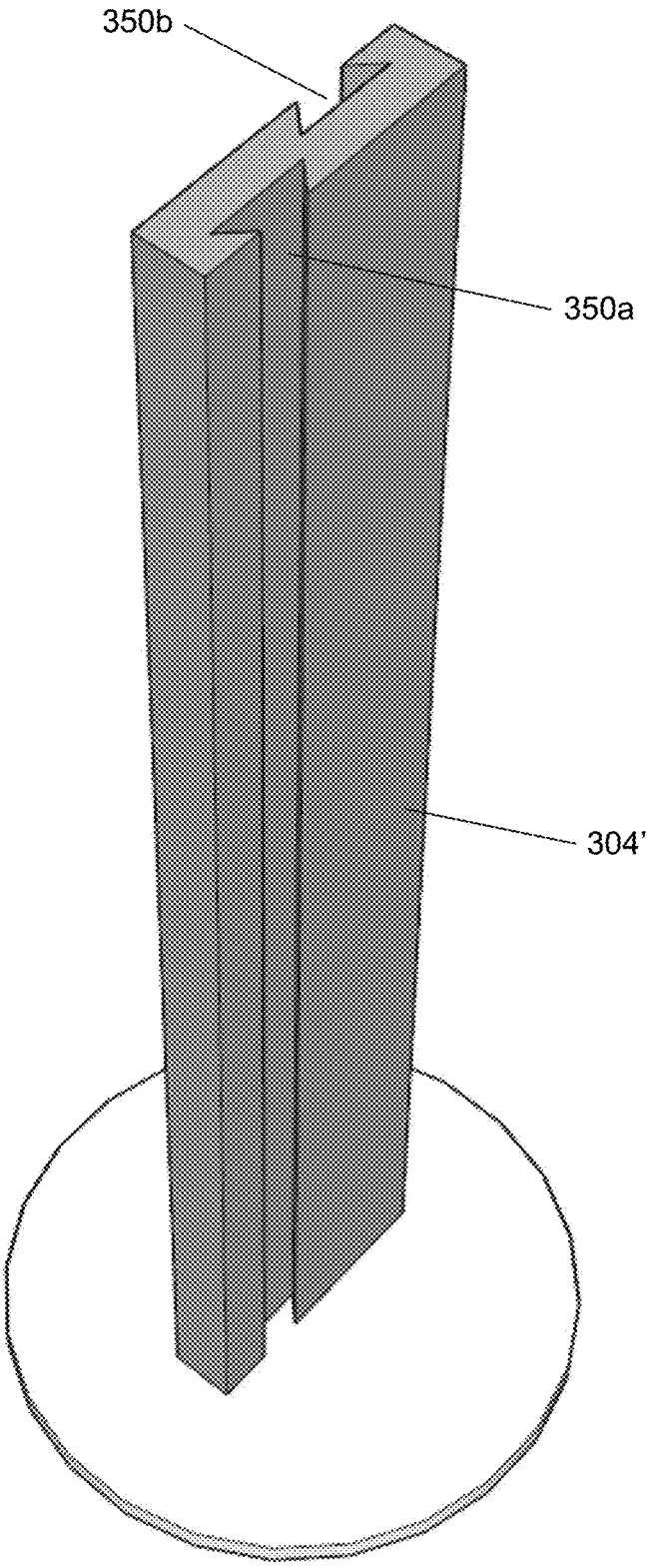
FIG. 3*i* is a detailed isometric view of a particular detail from the aspect illustrated in FIGS. 3A and 3B.

In some embodiments, it may be desirable for the vertical support 304 to have a thinner cross-section or thickness. The vertical support 304' illustrated in FIG. 3*i* shows a first vertical groove 350*a* which is laterally offset from a second vertical groove 350*b* such that the vertical support 304' may be thinner relative to the vertical support 304 illustrated in FIG. 3C.

Turning now to FIGS. 4A and 4B, there is an organizational system 400 having a base 402, a vertical support 404, and a handle 406. The vertical support 404 may be coupled to a plurality of shelf units 408. In the illustrative embodiment of FIG. 4A, the plurality of shelf units 408 are in an open configuration. In the illustrative embodiment of FIG. 4B, the plurality of shelf units 408 are in a closed configuration.

The upper portion of the vertical support 404 couples to the handle 406 which may be rotatable about an axis lateral to the longitudinal axis of the vertical support member. In certain embodiments, the handle 406 may be removable and couple to the top of the vertical support via a threaded stud (not shown) or a threaded aperture (not shown). The lower portion of the vertical support 404 may be either rotatably or fixedly coupled to the base 402. As illustrated in FIGS. 4A and 4B, the vertical support 404 may comprise a single vertical member at a lower end, which branches into two vertical support branches 409*a*-409*b* to support the plurality of shelf units 408. At an upper portion of the vertical support 404, the support branches 409*a*-409*b* may be once again joined into a single member or support.

In certain embodiments, apertures may be defined in the interior and opposing faces of the two support branches 409*a*-409*b*. The apertures may be aligned and positioned to face each other such that a horizontal supporting member may be inserted into one aperture in, for instance, support branch 409*a*, then inserted into the opposing aperture in support branch 409*b*, to support a shelf unit. As will be explained below, in certain embodiments, an individual shelf unit 408*a* may be supported from a lower supporting member. In other embodiments, the shelf unit 408*a* may be supported by an upper supporting member.

Figure 4C:
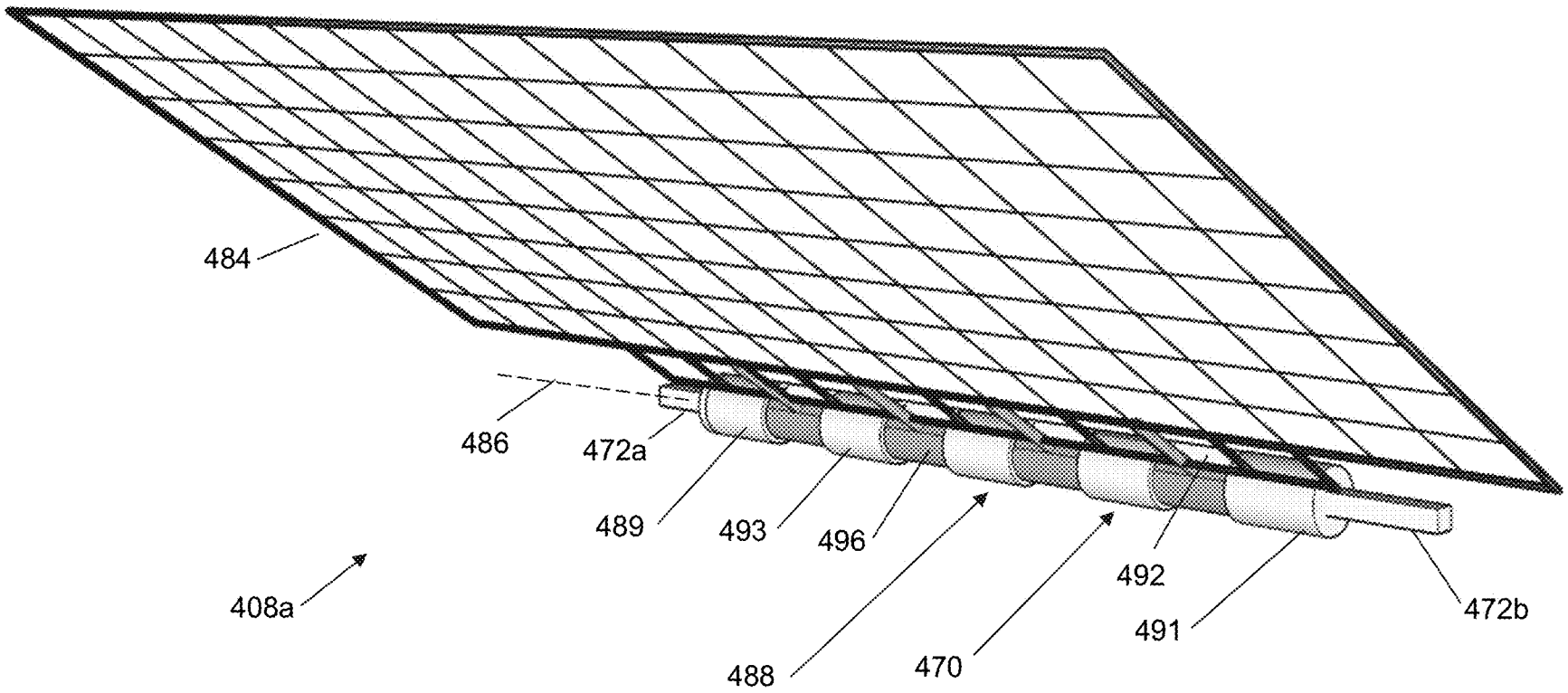
FIG. 4C is a detailed isometric view of the aspect illustrated in FIGS. 4A and 4B illustrating additional features.

For instance, FIG. 4C illustrates an embodiment of the individual shelf unit 408*a* having a shelf member 484 which is supported by a lower horizontal supporting member 470. In certain embodiments where the shelf member 484 is designed to rotate with respect to a lateral or horizontal axis 486, the lower supporting member 470 may include a self stopping hinge 488 or angular support unit (similar to the self stopping hinge unit 188 discussed above). Thus, in this illustrative embodiment, the lower supporting member 470 prevents the shelf member 484 from rotating past a predetermined angle relative to the horizontal or vertical.

Recall from the above discussion relating to FIGS. 1*i* and 1J, that the shelf unit 184 is fixedly coupled to the rotatable pin 196 and that the vertical member 182 is fixedly coupled to the exterior member 192 of the self stopping hinge 188. The rotatable pin 196 is able to rotate through a predefined rotational angle with respect to the exterior member 192 (See FIGS. 1*i* and 1J). Thus, the shelf unit 184 is also able to rotate with respect to the vertical member 182. In contrast, the shelf unit 408*a* does not have a vertical member. However, as will be explained below, ends 472*a* and 472*b* of the support member 470 do not rotate when coupled to the support branches 409*a* and 409*b* (FIGS. 4A and 4B), respectively. So, the self stopping hinge 488 allows the shelf unit 484 to rotate with respect to the support branches 409*a* and 409*b* as opposed to a vertical member.

Turning back to FIG. 4C, the end members 472*a* and 472*b* may be square or rectangular in cross-sectional shape (or any shape but round). The corresponding apertures defined within the support branches 409*a* and 409*b* are also square or rectangular in cross-section. Thus, when the end members 472*a* and 472*b* are inserted into their corresponding apertures defined within the vertical support branches 409*a* and 409*b*, the end members are prevented from rotating with respect to the vertical support branches. A pin 496 (conceptually similar to the pin 196 of FIGS. 1*i* and 1J) positioned within the support member 470 may rotate with respect to the end members 472*a* and 472*b*. Because the shelf member 484 is coupled to the pin 496, the shelf member 484 also can rotate with respect to vertical support branches 409*a* and 409*b* via the support member 470.

The end members 472*a* and 472*b* are rotationally fixed and coupled to end knuckles 489 and 491. The end knuckles 489 and 491 are coupled to an exterior member 492 (conceptually similar to the exterior member 192 of FIGS. 1*i* and 1J). The exterior member 492 may have other internal knuckles 493 partially enclosing the pin 496 and allowing the pin to rotate therein about the longitudinal axis 486. In this exemplary embodiment, the pin 496 is coupled to the shelf member 484. Thus, the self stopping hinge 488 may be similar to the self stopping hinge unit 188 discussed above, except that the self stopping hinge 488 includes end portions which from a rotational perspective, fixedly attach to apertures in the support branches 409*a*-409*b*.

Thus, the shelf member 484 may be able to rotate about the horizontal axis 486 which coincides to the longitudinal axis of the end members 472*a* and 472*b*. As illustrated in FIG. 4C, the shelf unit 408 is open to a predetermined angle (e.g., about 35 degrees from the horizontal). In other embodiments, the shelf unit 408 may open to other predetermined angles (such as ranging from 60 degrees from the horizontal to zero degree from the horizontal, or preferably around 35 degrees from the horizontal).

One or both of the ends 472*a* and 472*b* may be longitudinally slideable with respect to the exterior member 492. Additionally, the slideable end(s) may be coupled to an internal biasing or spring member (not shown) which biases the end member externally away from a center of the exterior member 492 along the longitudinal axis 486. When a longitudinal force is applied to a biased end, for instance, end 472*a*, the force overcomes the internal biasing member, which allows the end member 472*a* to move towards the longitudinal center of the exterior member 492. The effect of this movement is a longitudinal shortening of the entire support member 470. When the longitudinal force is released, the biasing member then exerts a force on the end 472*a* in the opposite direction which causes the end 472*a* to return to its original position.

The longitudinal slideable feature of one or both ends of the support member 470 allows a user to insert the support member between two opposing apertures defined in the branch supports 409*a* and 409*b*, even when the distance between the branch supports is shorter than the length of the support member 470. A user inserts the slideable end into an aperture defined within the support branch 409*a*, shortens the entire support member by exerting a longitudinal force to overcome the biasing member, which then allows the other end to be inserted in a corresponding aperture in the support branch 409*b*, the biasing member then returns the support member to its original length and the support member 470 spans between the two apertures.

As illustrated in FIG. 4C, the shelf member 484 may be made of a wire mesh with thicker support members around the edges and/or coupled to the hinge 488. In other embodiments, the shelf member 484 may be made from wood (e.g., bamboo), a laminated wood, metal (such as polished aluminum), laser cut metal, plastic, a structural paper material such as card board, or a flexible material, such as canvas, leather or faux leather. When the shelf member 484 is made from a flexible material, there may be a metal frame of thicker members supporting the flexible material.

FIG. 4B illustrates the shelf units 408 in a closed position. In other words, the vertical members and the shelf member 484 are generally parallel to each other or at a relatively narrow angle to each other. To open a shelf unit 408, the shelf member 484 may be pulled down which forces the pin 496 within the hinge member 488 to rotate about its longitudinal axis until faces abut (as explained above in reference to the hinge unit 188). At that point, the hinge unit 488 cannot rotate further. Consequently, the shelf member 484 will not rotate further.

Figure 4D:
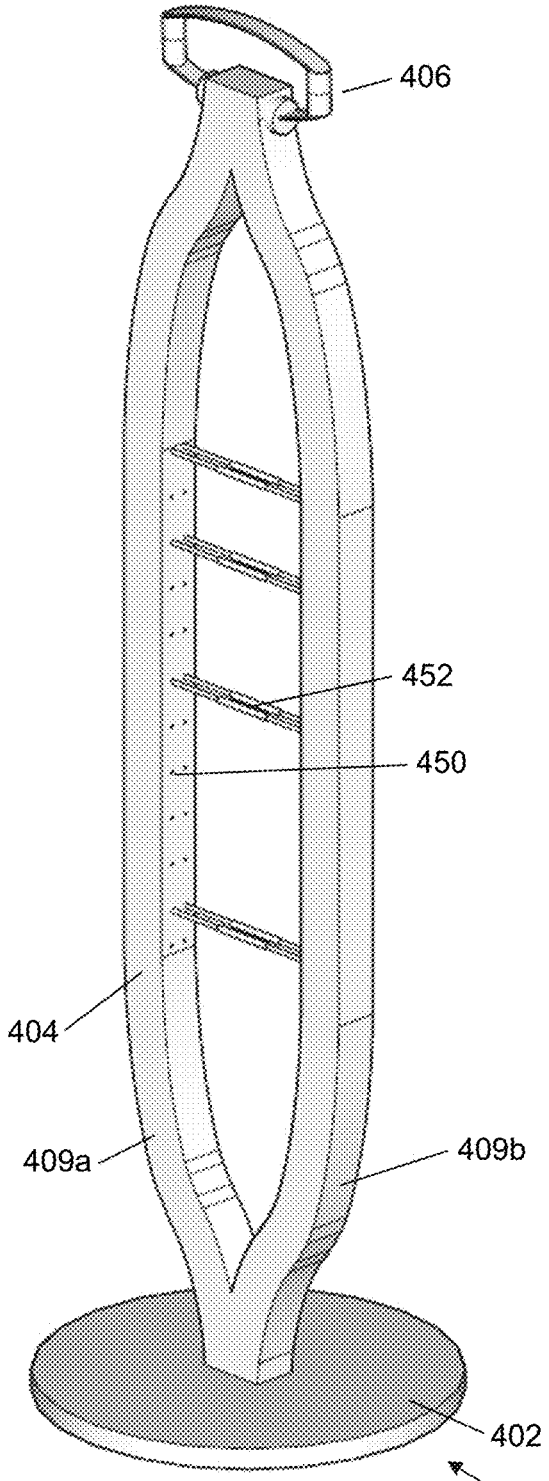
FIGS. 4D and 4E are isometric views illustrating one aspect of the present invention.
Figure 4E:
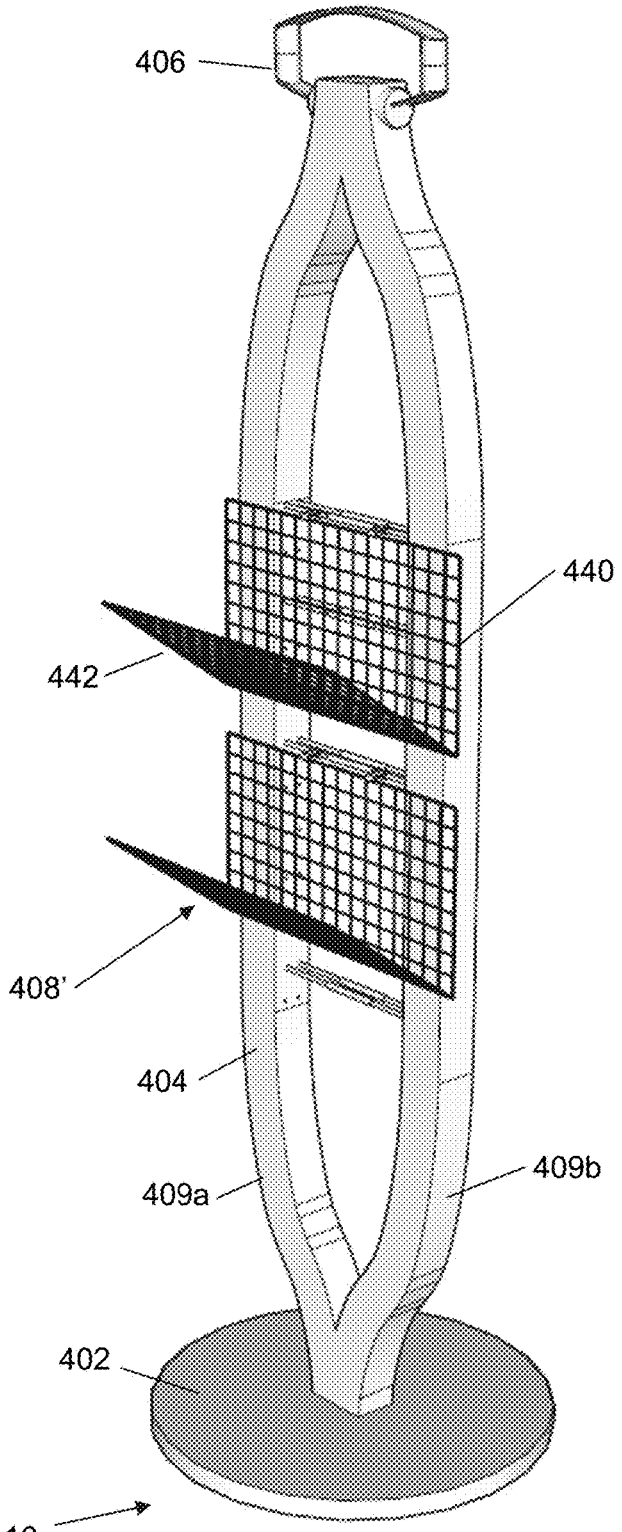

Turning now to FIGS. 4D and 4E, there is an organizational system 410 having a base 402, a vertical support 404, and a handle 406 as described above. In this embodiment, the vertical support 404 may be coupled to a plurality of shelf units 408'. In the illustrative embodiment of FIG. 4D, the plurality of shelf units 408' are not shown for clarity. In the illustrative embodiment of FIG. 4E, two of the plurality of shelf units 408' are illustrated.

In the system 400 illustrated by FIGS. 4A through 4C, the individual shelf units 408 are supported from a lower supporting member as discussed above. In the system 410 illustrated by FIGS. 4D through 4H, the individual shelf units 408' are supported by an upper horizontal supporting member 452. In certain embodiments, the individual shelf units 408' may be similar to the collapsible shelf unit 180 discussed above. In other embodiments, the individual shelf units 408' may be similar to fixed shelf unit 90 discussed above. In yet other embodiments, the individual shelf units 408' may be similar to the individual shelf unit 180, but having a fixed frame member instead of a hinge member and thus cannot rotate to an open position. In other words, the individual shelf units 408' may be fixed units where the intersection of an upper unit 440 and a shelf unit 442 comprises a frame member.

In certain embodiments, apertures 450 may be defined within the interior and opposing faces of the two branch supports 409*a* and 409*b*. The apertures 450 may be aligned to positionally face each other such that the support member 452 may be inserted into an aperture defined within the branch support 409*a*, then inserted into an opposing aperture in the branch support 409*b*. As will be explained below, the support member 452 may include a biasing component to allow a user to temporarily shorten the length of the support member so that an insertion can be made into the opposing aperture.

Figure 4F:
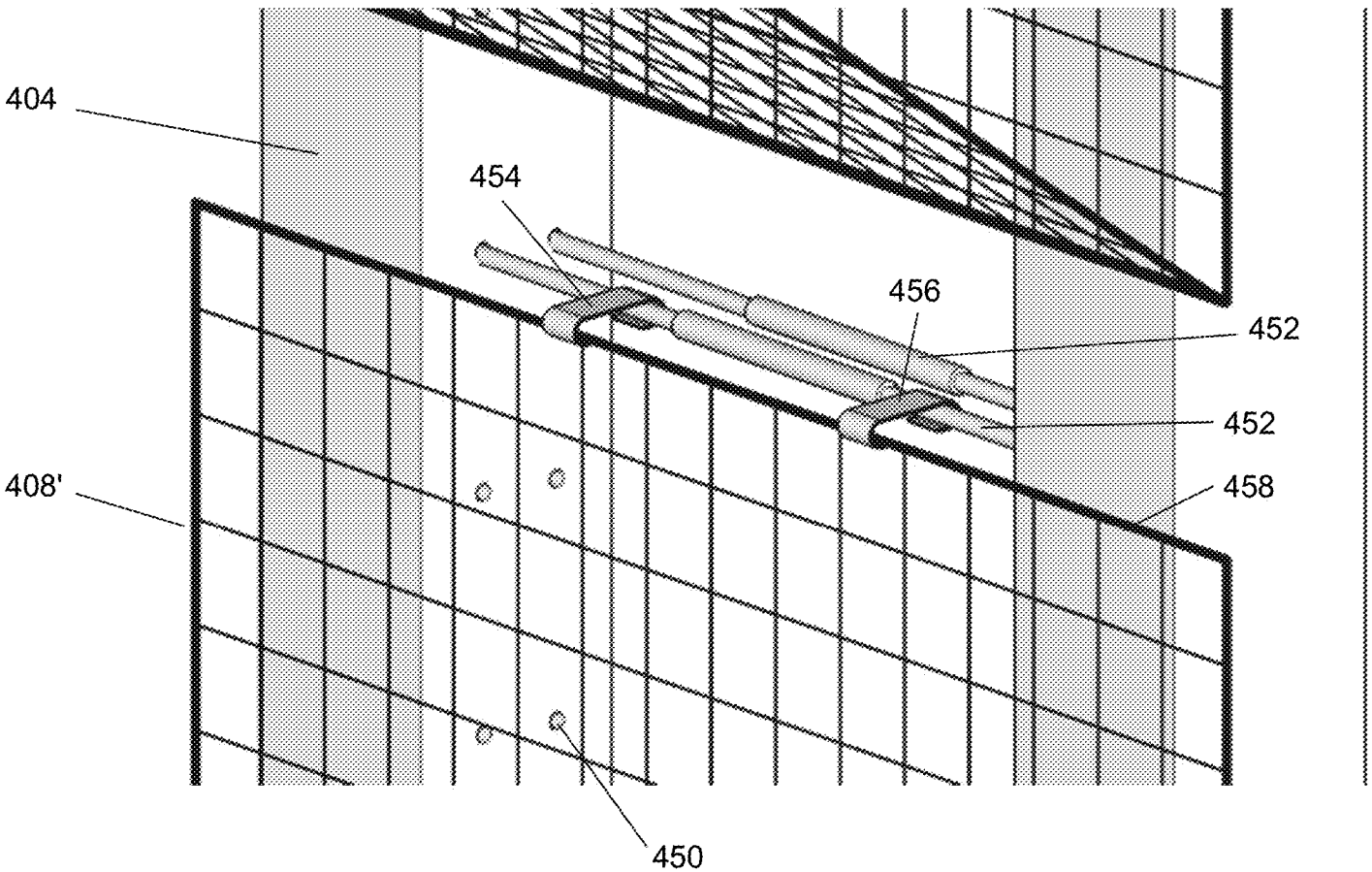
FIG. 4F is a detailed isometric view of the aspect illustrated in FIGS. 4D and 4E illustrating additional features.

FIG. 4F is a detailed view showing two connecting members 454 and 456 coupling the shelf unit 408' to a support member 452. As illustrated, there are two support members 452 positioned side by side to allow for another shelf unit 408' (not shown) to be placed on the opposing face of the vertical support 404. Of course, in this embodiment, the shelf units 408' do not have to be placed opposing each other, but may be placed at varying heights according to the needs of the user. In certain embodiments, the connecting members 454 and 456 may be metal clips in which one end extends circumferentially around a top wire frame member 458 and the other end extends circumferentially around the support member 452. Thus, when assembled, the shelf unit 408' hangs from the supporting member 452 via the frame member 458. In other embodiments, the support member 452 and connecting members 454 and 456 may be integral with the shelf unit 408' for a more aesthetically pleasing look.

Figure 4G:
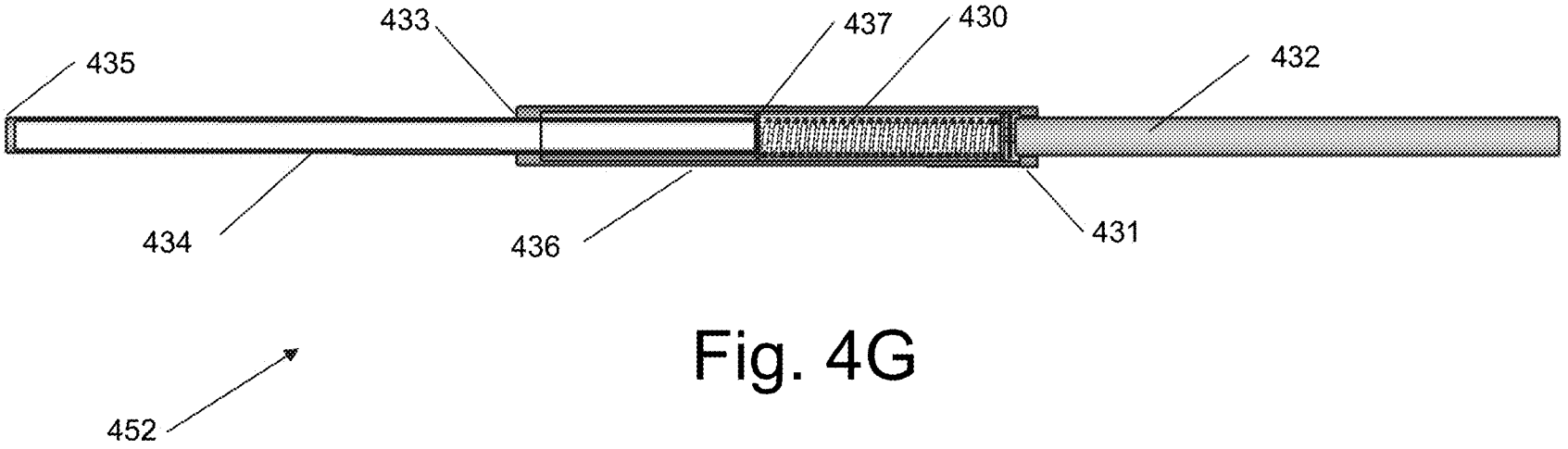
FIGS. 4G and 4H are detailed section views of a portion of the aspect illustrated in FIGS. 4D through 4F.
Figure 4H:
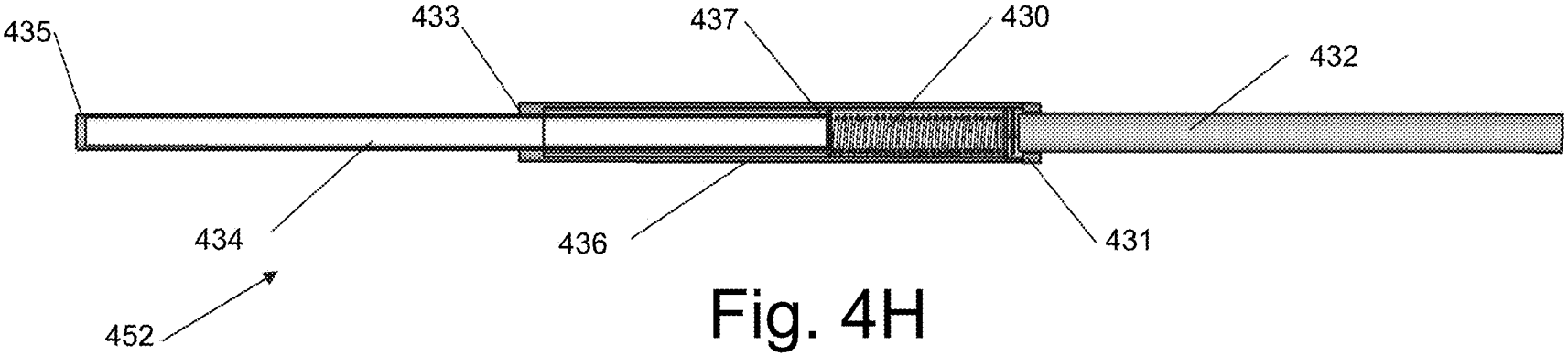

FIGS. 4G and 4H illustrate one embodiment of the support member 452. In FIG. 4G, the horizontal member is in an extended position. In FIG. 4H, the horizontal member 452 is in a collapsed or shortened position.

As illustrated, the horizontal member 452 comprises a biasing member 430, a fixed rod member 432, a moveable rod member 434, and a cylindrical enclosure 436. The fixed rod member 432 couples to an end 431 of the cylindrical enclosure 436 such that their longitudinal axes are aligned. An opposing end 433 of the cylindrical enclosure 436 has a circular opening having a smaller diameter than the interior diameter of the cylindrical enclosure. The moveable rod member 434 has one exterior or free end 435 which is outside of the cylindrical enclosure 436 and the opposing or interior end 437 positioned within the cylindrical enclosure. The opposing end 437 is coupled to an end cap which has a circular diameter just smaller than the interior diameter of the cylindrical enclosure 436, but larger than the diameter of the circular opening of the cylindrical enclosure at end 433. Thus, the end cap keeps the opposing end 437 of the moveable rod 434 within the cylindrical enclosure 436. The biasing member 430, such as a helical spring keeps the moveable member 434 (and therefore, the horizontal member 452) in the extended position unless a compressive force is applied to the support member 452 which overcomes the biasing force of the spring or biasing member 430.

In other words, when a sufficient compressive force is applied, the biasing forces are overcome and the supporting member 452 longitudinally shortens, thereby moving more of the moveable member 434 into the cylindrical enclosure 436 (as illustrated by FIG. 4H). This shortening allows a user to insert the supporting member 452 into opposing apertures as explained above even though the distance between the opposing apertures is less than the extended length of the support member 452.

Figure 5A:
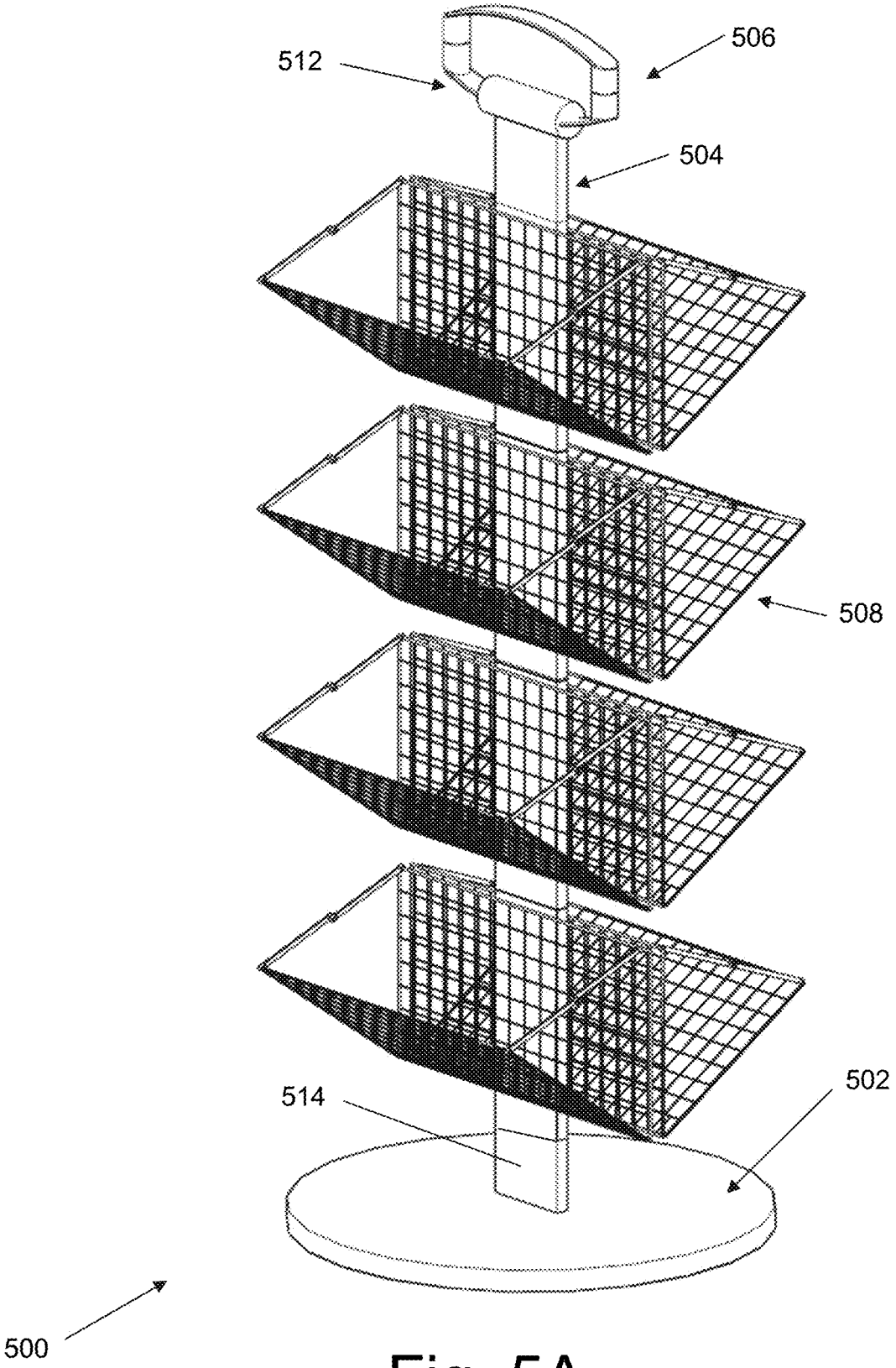
FIG. 5A is an isometric view of another aspect of the present invention.

Turning now to FIG. 5A, there is a modular organizational system 500 having a base 502, a vertical support 504, and a handle 506. The vertical support 504 may be coupled to a plurality of shelf units 508. In the illustrative embodiment of FIG. 5A, the plurality of shelf units 508 are in an open configuration.

The system 500 is vertically modular. In other words, in this embodiment, the vertical support 504 may be made from a plurality of stackable modules or units. The overall height of the system 500 depends on the number of stackable modules or units desired by the user. The upper portion of the vertical support 504 couples to a handle element 512 which includes a handle 506 which may be rotatable about an axis lateral to the longitudinal axis of the vertical support 504. The lower portion of the vertical support 504 couples to a base coupling element 514 which couples one of the modular units to the base 502. The base coupling element 514 may be either rotatably or fixedly coupled to the base 502.

Figure 5B:
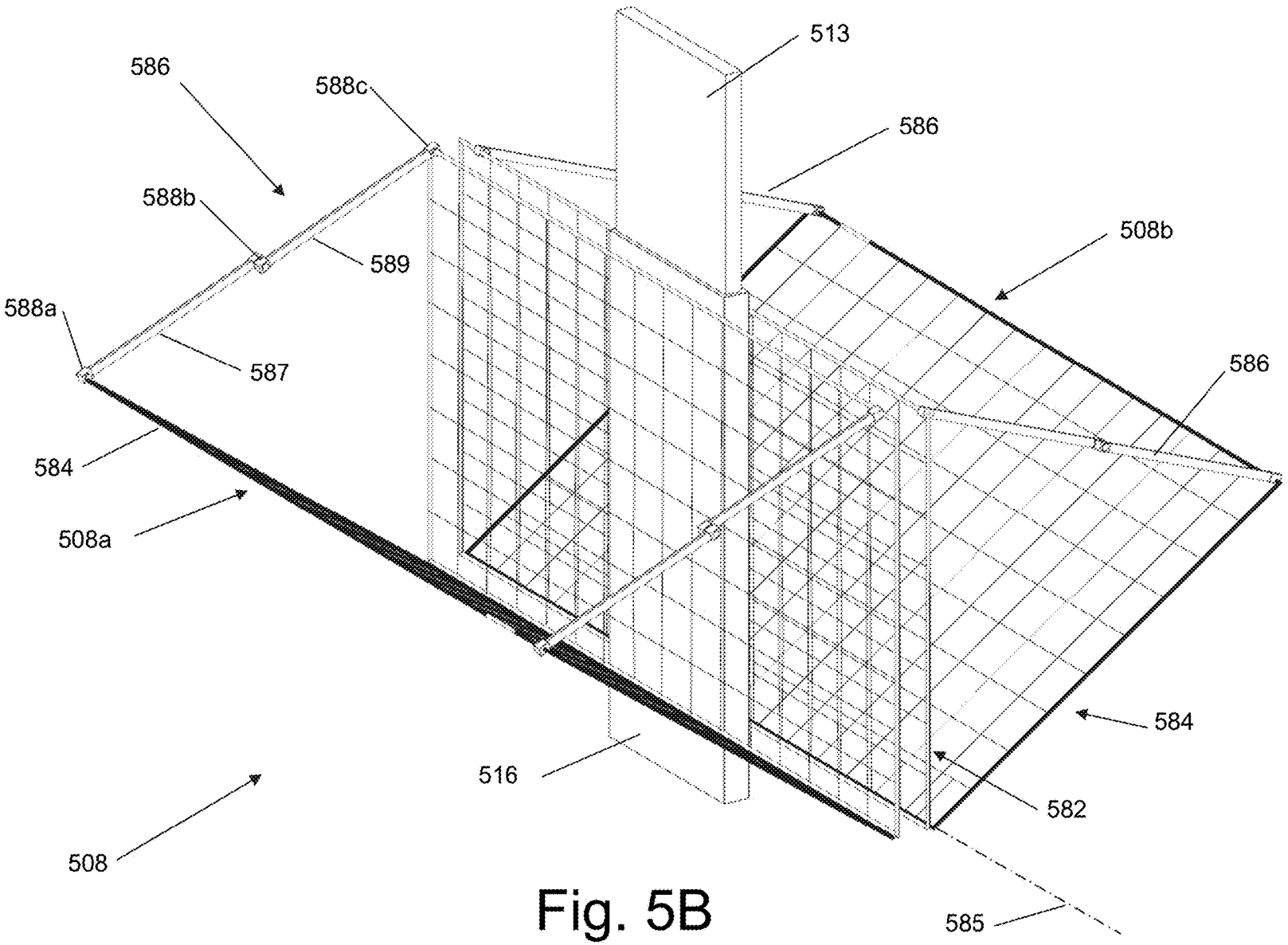
FIG. 5B is a detailed isometric view of a particular detail from the aspect illustrated in FIG. 5A.
Figure 5C:
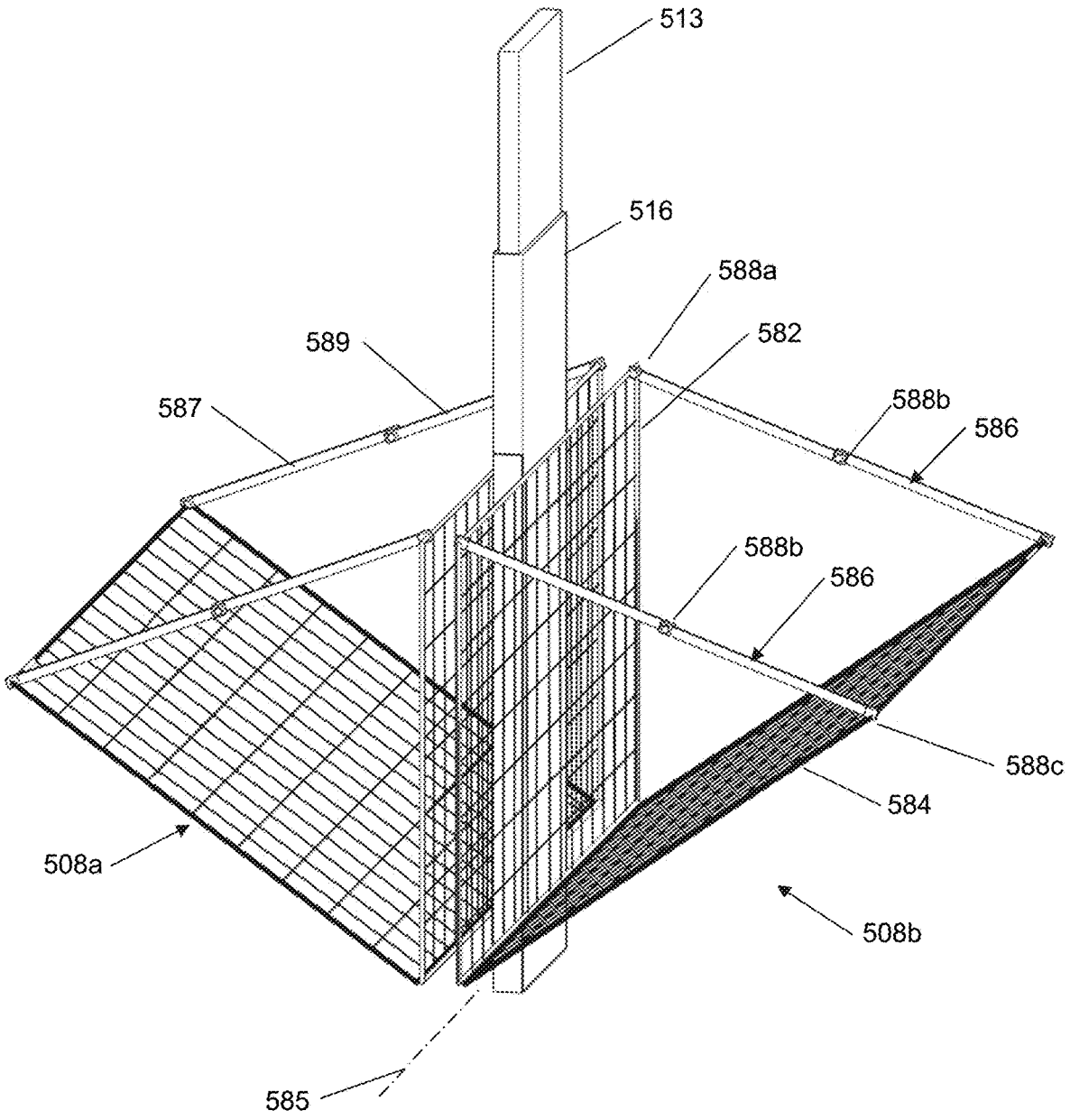
FIG. 5C is a detailed isometric view of a particular detail from the aspect illustrated in FIG. 5A.

Turning now to FIGS. 5B and 5C, there are detailed views of a modular shelf unit 508. In the illustrative embodiment, the modular shelf unit 508 comprises a vertical support unit 516 which is coupled to a first shelf unit 508*a* and a second or opposing shelf unit 508*b*. In certain embodiments, the vertical support unit 516 has a male upper end 513 sized to mate with a female lower end of another vertical support unit (not shown) or the handle element 512 discussed above. Thus, the upper end 513 has exterior dimensions which are slightly smaller than the exterior dimensions of the rest of the unit. The lower end of the vertical support member 516 has an opening (not shown) sized to mate with a male upper end 513 of another vertical support member (not shown) or an upper male portion of the base coupling element 514 (FIG. 5A). In certain embodiments, the vertical units may be coupled together through a frictional fit. In yet other embodiments, the vertical units may be secured using screws, clips or other mechanisms known in the art.

Although the vertical support unit 516 is illustrated having a rectangular shaped cross-section, any cross-sectional shape is within the scope of this invention, including tubular, square, circular, or polygonal. As with all of the embodiments of this specification, the vertical unit 516 may attach to the shelf units 508*a* in any manner described herein or in any manner known in the art, including the use of apertures and hooks, hooks only, screws, glue, etc. In other embodiments, a vertical member 582 of the shelf units 508*a* and 508*b* may be integral with the vertical support unit 516. In other words, the vertical support unit 516 may be as wide as a shelf unit 584. As with all embodiments in the specification, any shelf unit described herein may be used in combination with any vertical support or vertical support unit described in this disclosure.

As illustrated, the shelf unit 508*a* or 508*b* may comprise a vertical member 582 and the shelf member 584. The shelf member 584 may be able to rotate about a horizontal axis 585 which is proximal to the planar intersection of the vertical member 582 and the shelf member 584. As illustrated in FIGS. 5B and 5C, the shelf units 508*a* and 508*b* are opened to a predetermined angle (e.g., about 35 degrees from the horizontal). In other embodiments, the shelf unit 508 may open to other predetermined angles (such as ranging from 60 degrees from the horizontal to zero degree from the horizontal, or preferably around 35 degrees from the horizontal).

In certain embodiments, there may be a plurality of tubular members, a hinge (such as hinge 200 discussed above), or conventional piano hinge coupling the lower or interior edges of the vertical member 582 to the shelf member 584. In certain embodiments, there may be one or more angular support units which prevent the shelf member 584 from rotating past the predetermined angle relative to the vertical member 582. In the embodiment illustrated in FIGS. 5B and 5C, the angular support unit is one or more brace members 586 which couples the top or exterior edge of the vertical member 582 to the top or exterior edge of the shelf member 584. For instance, hinges 588*a*-588*c* allow the brace components 587 and 589 to fold downward when the shelf unit 508 is in a closed position and to extend laterally to support the shelf member 584 when the shelf unit 508 is in an open position as illustrated in FIGS. 5B and 5C. In other embodiments, the brace members may couple to a side edge of the vertical member 582.

As illustrated in FIGS. 5B and 5C, the vertical member 582 and/or the shelf member 584 may be made of a wire mesh with thicker support or frame members around the edges and/or coupled to a hinge at the intersecting plane. As with all of the shelf units described in this specification, the vertical member 582 and/or the shelf member 584 may be made from wood (e.g., bamboo), a laminated wood, metal (such as polished aluminum), laser cut metal, plastic, or a flexible material, such as canvas, leather or faux leather. When the vertical member 582 and the shelf member 584 are made from a flexible material, there may be a metal frame of thicker members supporting the flexible material.

Figure 6A:
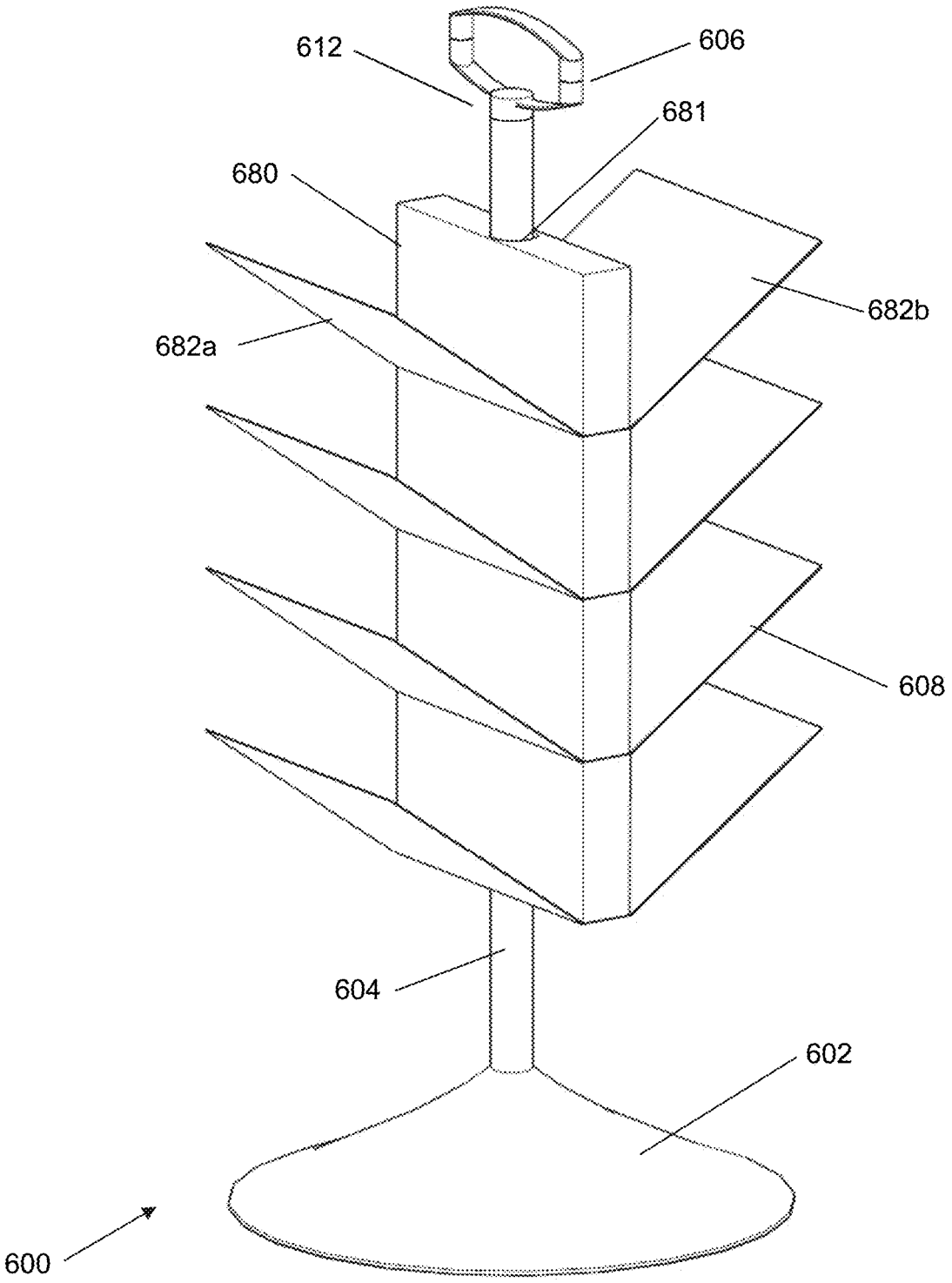
FIG. 6A is an isometric view of another aspect of the present invention showing additional details.
Figure 7A:
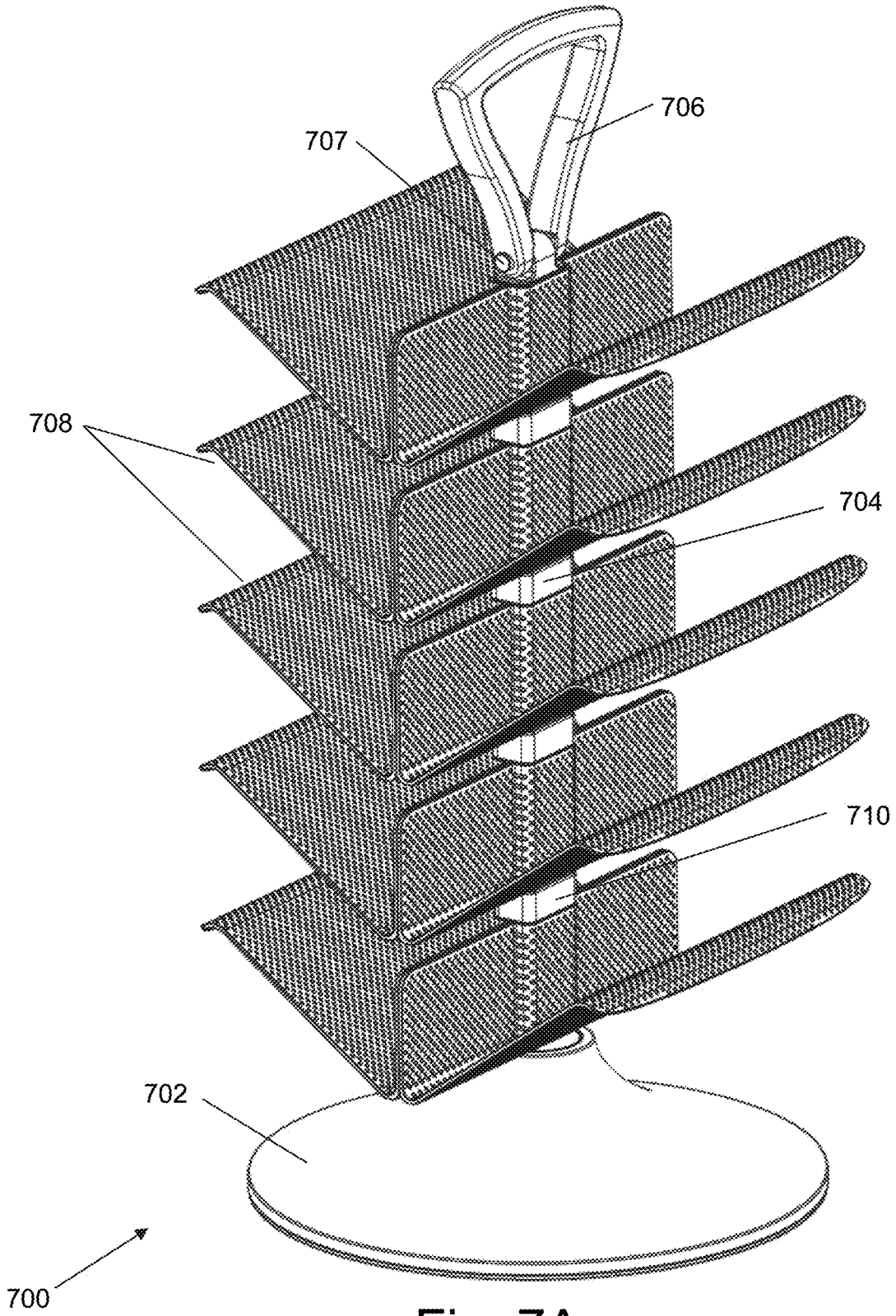
FIG. 7A is an isometric view of another aspect of the present invention showing additional details.

Turning now to FIG. 6A, there is a modular organizational system 600 having a base 602, a vertical support 604, and a handle 606. The vertical support 604 may be coupled to a plurality of shelf units 608. In the illustrative embodiment of FIG. 6A, the plurality of shelf units 608 are in an open configuration.

The system 600 may be modular. In other words, the individual shelf units 608 are stackable modules or units. Thus, the number of shelves depends on the number of stackable modules or units used or desired by a user or the height of the vertical member.

The upper portion of the vertical support 604 couples to a handle component 612. In certain embodiments, the handle component 612 may be removable and may couple to the top of the vertical support 604 via a threaded stud and/or a threaded aperture. The handle component 612 includes a handle 606 which may be rotatable about an axis lateral to a longitudinal axis of the vertical support 604. With the handle element 612 removed, the shelf units 608 can slide over the vertical support 604. Although the vertical support is illustrated as a column with a circular cross-section, the vertical support 604 may have any cross-sectional shape, including square, rectangular, or polygonal. In certain embodiments, the vertical support 604 may be fixedly or rotatably attached to the base 602.

In the illustrative embodiment, the shelf units 608 may have a center member 680 coupled to shelf members 682*a* and 682*b*. A self stopping hinge, such as hinge 188 or 200 discussed above, may couple the center member 680 to the shelf members 682*a* and 682*b*. In other embodiments, the shelf members 682*a* and 682*b* may be fixed relative to the center member 680. In yet other embodiments, there may be angular support units, such as brace members 586*a* and 586*b* discussed above. The center member 680 has a center aperture 681 sized to allow the center member to slide over and around the vertical support member 604.

Figure 6B:
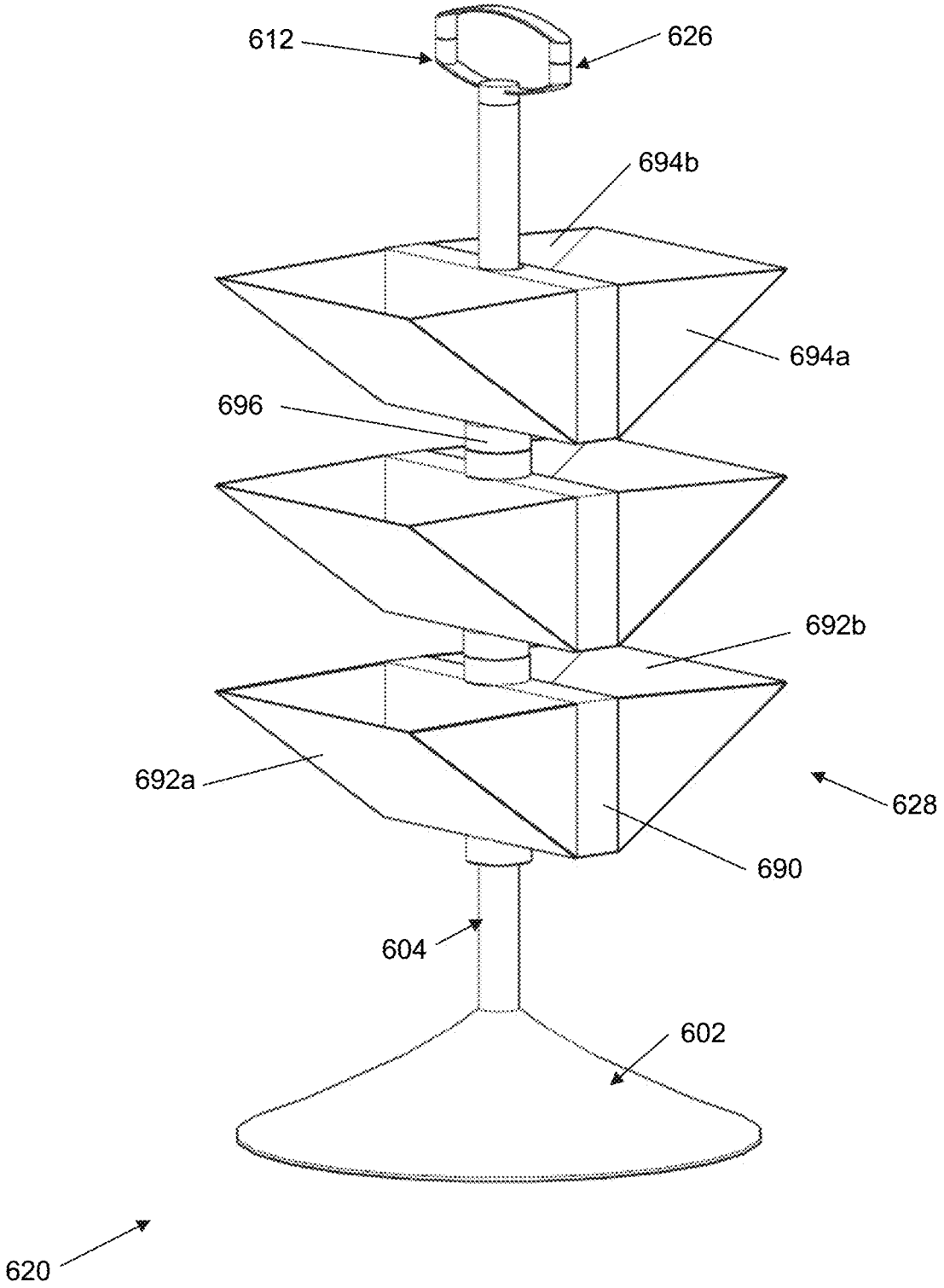
FIG. 6B is an isometric view of another aspect of the present invention showing additional details.

Turning now to FIG. 6B, there is a modular organizational system 620 which is similar to the system 600 discussed above. In this exemplary embodiment, the system 620 uses the same base 602, the vertical support 604, and the handle component 612 discussed above. The vertical support 604 may be coupled to a plurality of shelf units 608 discussed above or slightly different shelf units 628 as illustrated in FIG. 6B. In the illustrative embodiment of FIG. 6B, the plurality of shelf units 628 are in an open configuration.

The shelf units 628 may have a center member 690 coupled to shelf members 692*a* and 692*b*. A hinge or hinge like element may couple the center member 690 to the shelf members 692*a* and 622*b* if the shelf members 692*a* and 692*b* are collapsible or rotatable. In other embodiments, the entire shelf unit 628 may be made from a non-flexible material such as plastic and thus, remain in an open configuration.

In the embodiment illustrated in FIG. 6B, side walls 694*a* and 694*b* act as an angular support element to secure or support the shelf members 692*a* and 692*b* at a predetermined angle. In other embodiments, there may only be one side wall 694*a*. Although the side walls 694*a* and 694*b* are illustrated as triangular shapes, in other embodiments the top edge of the side walls 694*a* and 694*b* may be parallel to the bottom edge of the sidewall. Thus, producing a side with a parallelogram shape.

As illustrated in FIG. 6B, one or more spacers 696 may be vertically positioned between the shelf units 628 so that the user can adjust the height between the shelf units. Each spacer 696 has an interior aperture 697 (FIG. 6C) sized so that the spacer can slide over the vertical support 604. However, the exterior dimensions of each spacer are such that the spacer acts as a stop for any shelf unit 628 or 608 positioned around the vertical support 604 and above the spacer. In other words, the spacer 696 prevents any and all shelf units positioned above the spacer from sliding further down than the spacer because the exterior dimensions of the spacer are larger than the center aperture 681 defined within the center member 680 of the shelf units 608 or 628.

Figure 6C:
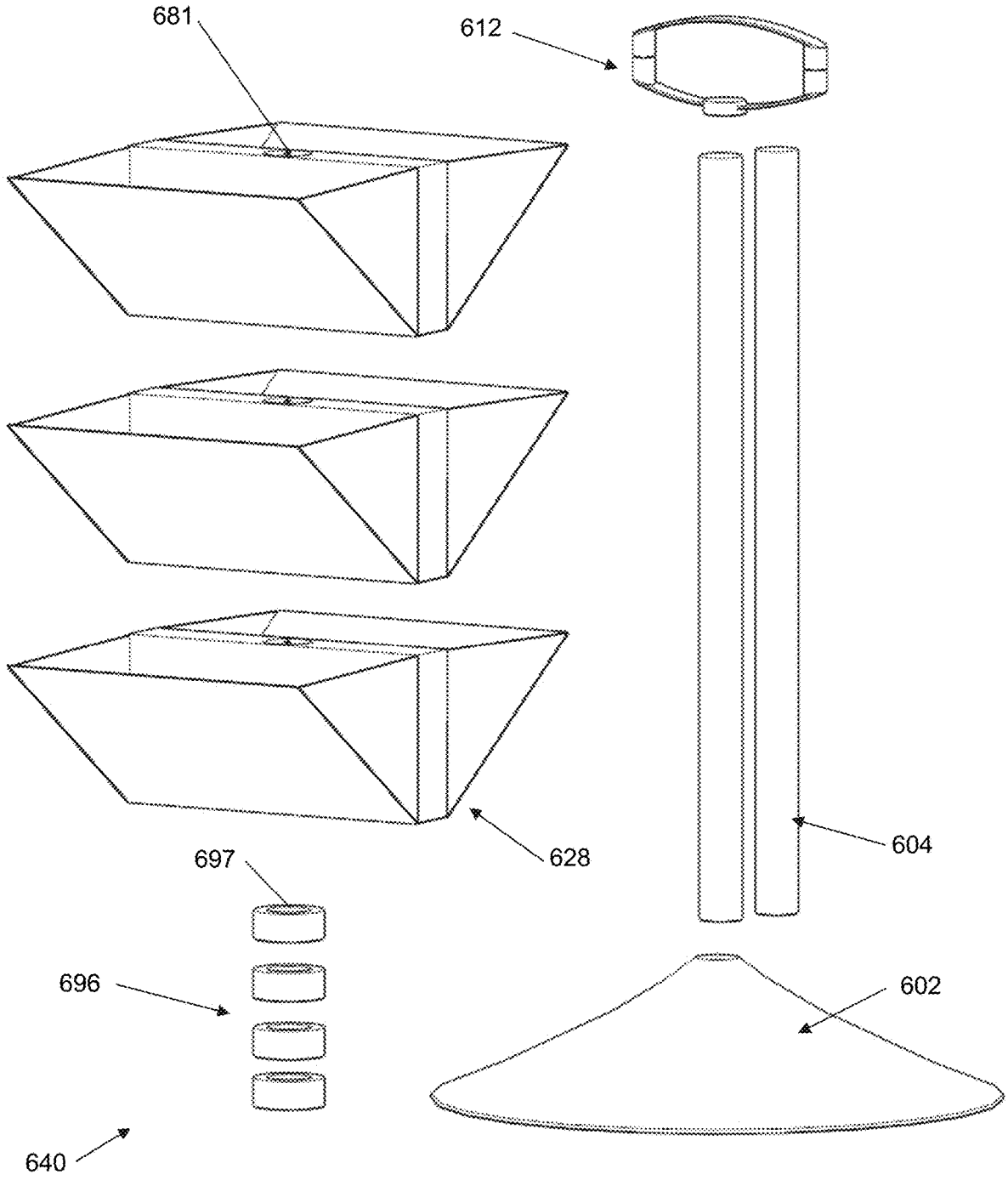
FIG. 6C is an exploded isometric view of the aspect illustrated in FIG. 6B illustrating additional features.

FIG. 6C represents a modular kit 640 for the unassembled system 620. The modular kit 640 may include any base, vertical support, handle or handle component, spacers, or shelf units discussed throughout this application. For purposes of illustration only, the kit 640 includes a base, such as base 602, the vertical support 604 (which is represented by two stackable and circular columns), a handle component 612, a plurality of spacers, such as spacers 696, and a plurality of shelf units, such as shelf units 608 (see FIG. 6A) or 628.

The shelf units may include fixed or rotatable shelves. Furthermore, the shelf units may have a shelf on only one side or have shelves which are independently attachable to a vertical unit or center unit. This flexibility allows a user to customize the distance between the shelves. Furthermore, one or more spacers 696 also allow a user to customize the distance between the shelves to suit the user's individual requirements.

Figure 6D:
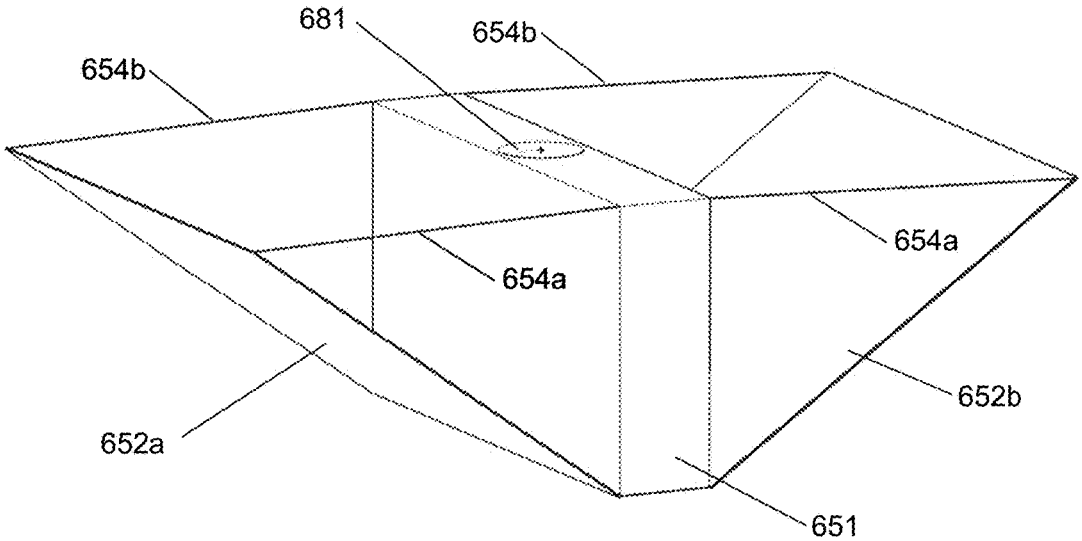
FIG. 6D is a detailed isometric view of an alternative detail.

Turning now to FIG. 6D, there is a shelf unit 650 which may also be used in the systems 600, 620 or kit 640. The shelf unit 650 has a center member 651 coupled to shelf members 652*a* and 652*b*. A hinge or hinge like element may couple the center member 651 to a lower or interior edge of the shelf members 652*a* and 652*b*. In this embodiment, a flexible material covers the shelf members 652*a* and 652*b*.

Tension elements 654*a* and 654*b* act as angular support elements to secure or support the exterior or upper edge of the shelf members 652*a* and 652*b* to the center member at a predetermined angle.

The center member, such as the center member 651 may be built with a wire or metal frame and may or may not have a covering. In other embodiments, there may only be a side covering. In some embodiments, the center member may be made from wood (e.g., bamboo), a laminated wood, metal (such as polished aluminum), laser cut metal, plastic, a structural paper material such as card board, or a flexible material, such as canvas, leather or faux leather. When the shelf members 692*a*-692*b* are made from a flexible material, there may be a metal frame of thicker members supporting the flexible material.

Figure 6E:
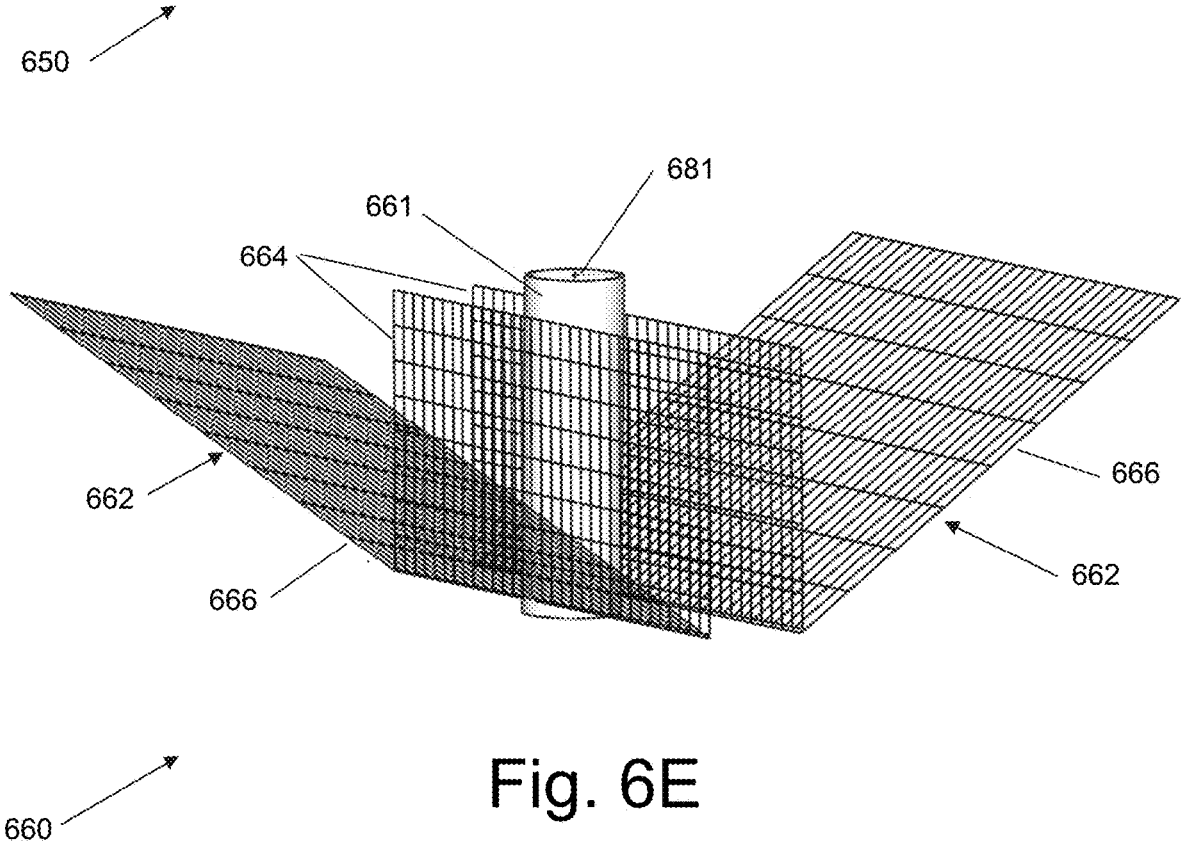
FIG. 6E is a detailed isometric view of an alternative detail.

FIG. 6E illustrates another embodiment of a shelf unit 660. The shelf unit 660 includes a tubular member 661 which is sized to slide over a vertical support, such as vertical support 604 (FIGS. 6A-6C). The tubular member 661 may be coupled to one or two shelf units 662 each comprising vertical members 664 which are in turn coupled to shelf members 666. The shelf units 662 may be similar to any of the shelf units described in this specification, for instance: shelf unit 90 of FIG. 1K, shelf unit 180 of FIG. 1G, or shelf unit 508 of FIG. 5A.

Thus, when a user is assembling the system 640, the user may couple the base 602 to the vertical support 604. If desired, the user may insert the vertical support through a spacer to give vertical height to the bottom of a first shelf unit. The user may then slide a shelf unit, such as shelf units 608, 628, 650, or 660 over the vertical support 604 until the shelf unit rests on the base 602 or the spacer or another stop. The center aperture 681 is sized to allow the vertical support 604 to be inserted therein and to allow the center aperture to slidingly engage the support 604. The user may then slide another shelf unit over the vertical support. Alternatively, if the user wishes more height between the shelf units, the user may slide one or more spacers to increase the distance between the shelf units. Once the user has completed coupling the shelf units to the vertical support, the user may attach the handle component 612 to the vertical support 604 to complete the assembly.

Turning now to FIG. 7A, there is a modular organizational system 700 having a base 702, a vertical support 704, and a handle 706. The vertical support 704 may be coupled to a plurality of shelf units 708 and/or a plurality of spacers 710. In the illustrative embodiment of FIG. 7A, the plurality of shelf units 708 are fixed or non-rotatable with respect to the vertical, thus they are in an open configuration.

The system 700 may be modular. In other words, the individual shelf units 708 are stackable modules or units. Thus, the number of shelves depends on the number of stackable modules or units used or desired by a user and/or the height of the vertical support desired by the user.

The upper portion of the vertical support 704 couples to a handle 706. In certain embodiments, the handle 706 may be removable and couple to the top of the vertical support 704 via a threaded stud and/or a threaded aperture (not shown). The handle 706 itself may be rotatable about an axis lateral to a longitudinal axis of the vertical support 704. In yet other embodiments, there may be a removable pin 707 coupling the handle 706 to the vertical support 704.

With the handle element 706 removed, the shelf units 708 can slide over the vertical support 704. Although the vertical support 704 is illustrated as a column with a rectangular cross-section, the vertical support may have any cross-sectional shape, including square, rectangular, or polygonal. In certain embodiments, the vertical support 704 may be fixedly or rotatably attached to the base 702.

As illustrated in FIG. 7A, one or more spacers 710 may be vertically positioned between the individual shelf units 708 so that the user can adjust the height between the shelf units. Each spacer 710 has an interior aperture 712 (FIG. 7D) sized so that the spacer can slide over the vertical support 704. However, the exterior dimensions of each spacer are such that the spacer acts as a stop for any shelf unit 708 positioned around the vertical support 704 and above the spacer. In other words, the spacer 710 prevents any and all shelf units positioned above the spacer from sliding further down than the spacer because the exterior dimensions of the spacer are larger than a center aperture 781 defined within the center member 780 (see FIG. 7C) of the shelf units 708.

Figure 7B:
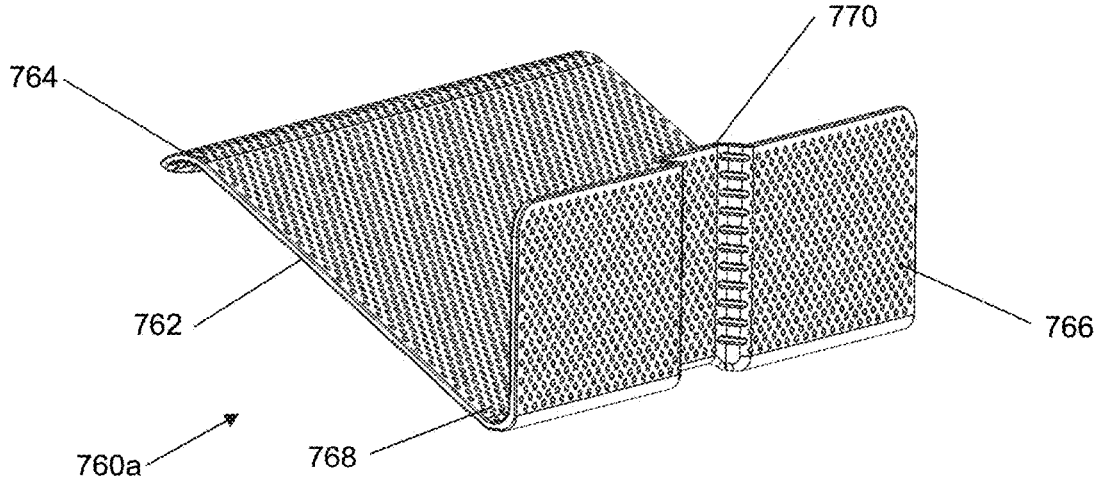
FIG. 7B is a detailed isometric view of a particular detail from the aspect illustrated in FIG. 7A.
Figure 7C:
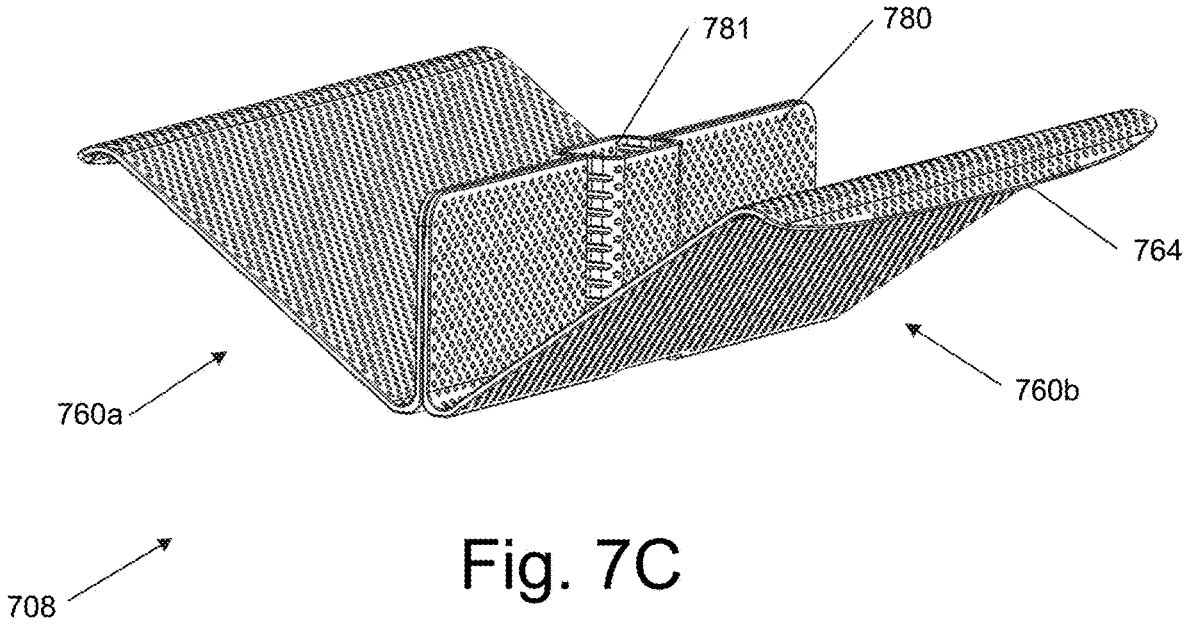
FIG. 7C is a detailed isometric view of a particular detail from the aspect illustrated in FIG. 7A.

FIG. 7B illustrates one half or a first component 760*a* of a single shelf unit 708. FIG. 7C illustrates two components 760*a* and 760*b* joined together to form the entire shelf unit 708. In the exemplary embodiment illustrated in FIGS. 7A through 7C, the shelf components 760*a* and 760*b* are each formed from sheet metal having a laser cut pattern to reduce weight. In other embodiments, the shelf components 760*a* and 760*b* may be made of a wire frame and wire mesh similar to that illustrated in FIG. 1K above.

Turning back to FIG. 7B, the shelf component 760*a* comprises a shelf or shelf member 762. The shelf member 762 is positioned at an angle with respect to the vertical or horizontal as described above with respect to other embodiments. Generally, the shelf member 762 angles downward from an exterior portion to an interior portion (which is close to the vertical support 704). In certain embodiments, the exterior portion may create a lip 764. A vertical member 766 intersects with the shelf member 762 at the interior portion forming a V shaped valley 768. In certain embodiments, the vertical member may include a vertical notch 770 defined therein at about a lateral center of the shelf component. The vertical notch 770 may be of a sufficient size and shape so as to allow approximately half of the cross-sectional area of the vertical support 704 to fit within the notch.

FIG. 7C illustrates the shelf components 760*a* and 760*b* joined together to form a single the shelf unit 708 having a single center member 780 which was formed by the joining of the vertical members 766 of each shelf component 760*a* and 760*b*. Once the vertical members 766 are joined to form one center member 780, the aperture 781 is also formed. The aperture 781 is sized to allow the vertical support member 704 to be slidingly inserted. In other words, the aperture is sized to allow the shelf unit 780 to be slid over the vertical support 704.

Figure 7D:
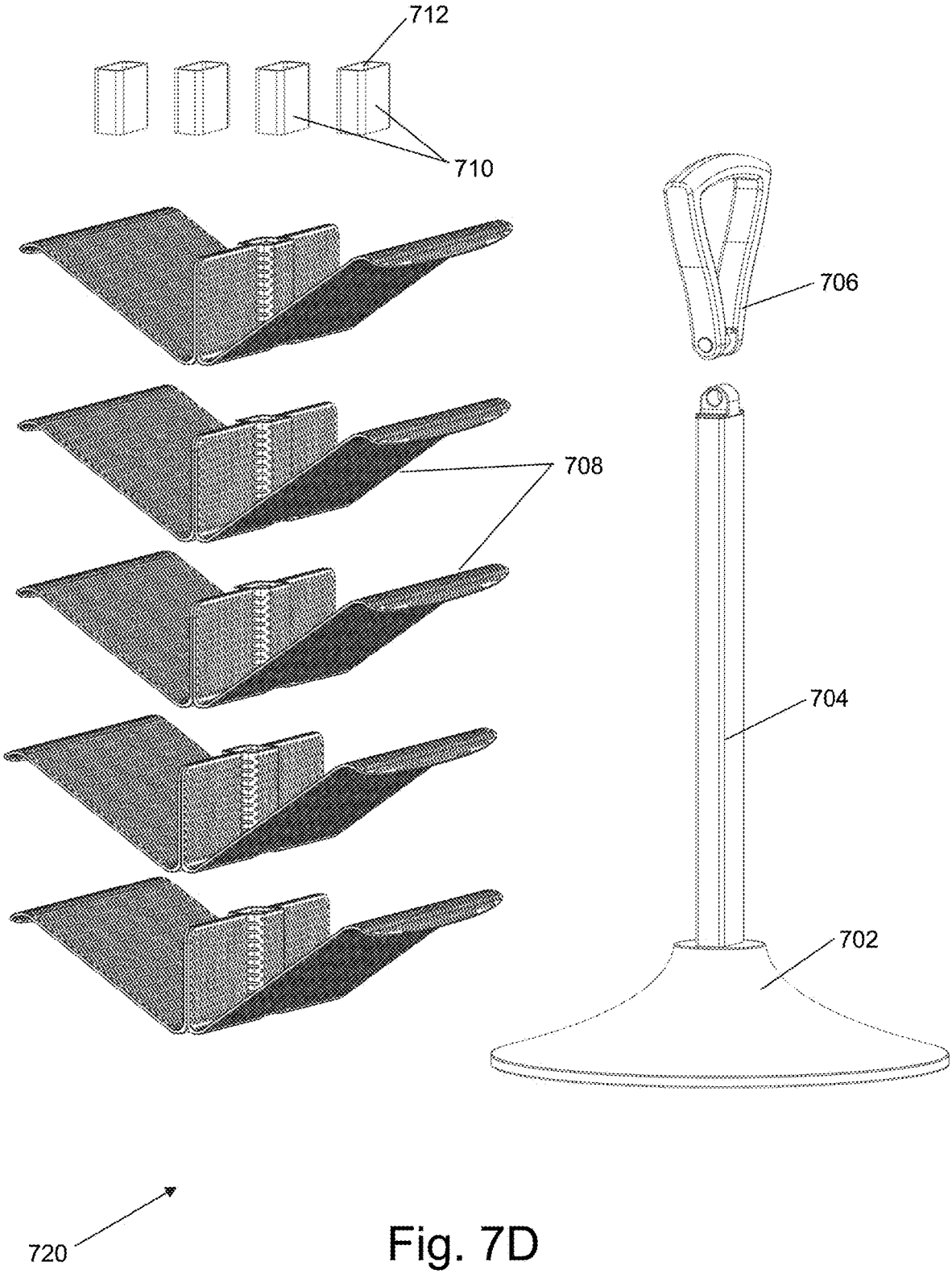
FIG. 7D is an exploded isometric view of the aspect illustrated in FIG. 7A illustrating additional features in an unassembled form.
Figure 7E:
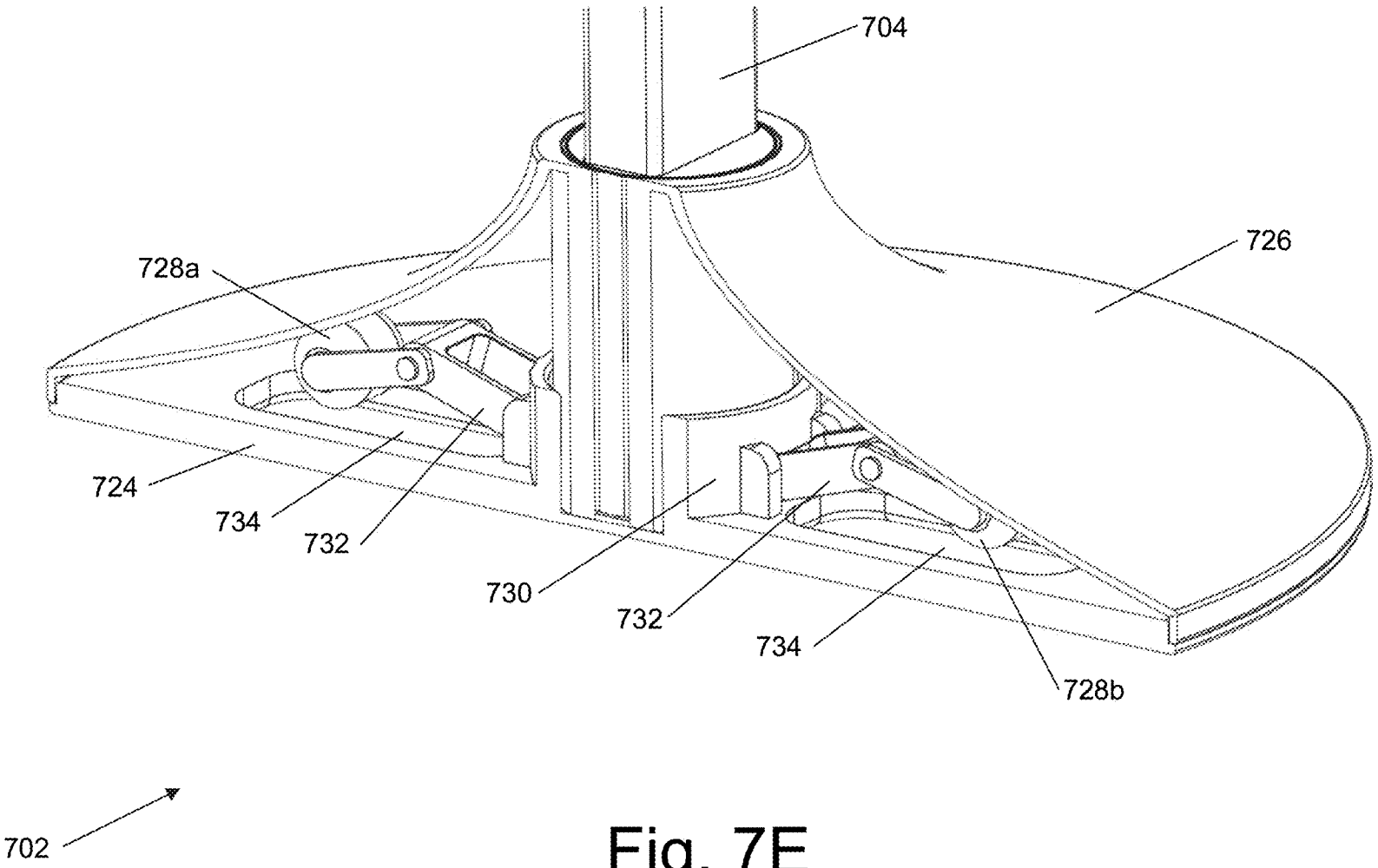
FIG. 7E is a detailed sectional isometric view of a particular detail from the aspect illustrated in FIG. 7A.

FIG. 7D represents a modular kit 720 for the unassembled system 700. The modular kit 720 may include any base, vertical support, handle or handle component, spacers, or shelf units discussed throughout this application. For purposes of illustration only, the kit 720 includes a base, such as base 702, the vertical support 704, the handle 706, the plurality of spacers 710, and a plurality of shelf units, such as shelf units 708.

Although the shelf units 708 are illustrated as made from sheet metal, the shelf units may be made from any appropriate material including wood (e.g., bamboo), a laminated wood, plastic, a composite material having a leather or faux leather exterior or a flexible material, such as canvas, leather or faux leather. When the shelf unit is made from a flexible material, there may be a metal frame or thicker members supporting the flexible material.

Thus, when a user is assembling the system 720, the user may couple the base 702 to the vertical support 704. If desired, the user may insert a spacer 710 over and around the vertical support 704 to give vertical height to the bottom of a first shelf unit. The user may then slide a shelf unit, such as shelf units 708 over and around the vertical support 704 until the shelf unit rests on either the base 702 or the spacer 710 (or another stop). As discussed above, the center aperture 781 is sized to allow the vertical support 704 to be inserted therein and to allow the center aperture to slidingly engage the support 704. The user may then slide another shelf unit 708 over the vertical support 704 to provide a second pair of shelves. Alternatively, if the user wishes more height between the shelf units, the user may slide one or more spacers 710 to increase the distance between the shelf units. Once the user has completed coupling the shelf units to the vertical support, the user may attach the handle component 706 to the vertical support 704 to complete the assembly of the system.

Having thus described the present invention by reference to certain of its embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The above disclosure contains several embodiments of elements such as a vertical support, a base, a handle, and shelf units. One skilled in the art would recognize that different embodiments of elements are combinable according to present or future claims—whether or not the combination is specifically described in the specification above. For instance, the vertical support, base, and handle described in reference to FIG. 5A may be combinable with any one of the shelf units described above, such as shelf unit 90 of FIG. 1K.

Thus, possible embodiments of the present invention may include a free standing storage system, comprising: a base; at least one vertical support member having a first end and a second end, wherein the first end is coupled to the base; a handle component coupled to the second end of the at least one vertical support member; at least one fixed or removable shelf unit comprising a first shelf member extending from the vertical support member at a predetermined angle.

Other embodiments and refinements may include the free standing storage system described above, further comprising a vertical shelf member rotatably coupled to the first shelf member.

Other embodiments and refinements may include the free standing storage system described above, further comprising a vertical shelf member fixedly coupled to the first shelf member.

Other embodiments and refinements may include the free standing storage system described above, further comprising a plurality of rollers coupled to a bottom wall of the base.

Other embodiments and refinements may include the free standing storage system described above, wherein the plurality of rollers are retractable.

Other embodiments and refinements may include the free standing storage system described above, further comprising a relatively frictionless surface coupled to the base.

What is claimed is:

1. A paper storage system comprising:

a rectangular column having an upper portion, a lower portion, a first side, a second side, and a longitudinal axis, a first longitudinal groove defined within the first side of the rectangular column, a second longitudinal groove defined within the second side of the rectangular column, a base rotatably coupled to the lower portion of the rectangular column wherein the base is coupled to a bottom glideable surface;

a handle assembly attachable to the upper portion of the rectangular column such that the handle assembly is rotatable around an axis which is transverse to the longitudinal axis and such rotation is limited to 180 degrees;

a plurality of shelving units wherein each shelving unit comprises a vertical component sized to slidingly engage and fit within either the first longitudinal groove or the second longitudinal groove;

a shelf component having at least one frame member;

a self stopping hinge coupled to the vertical component and the shelf component such that the shelf component can rotate with respect to the vertical component from a closed position to an open position, and a plurality of spacers sized to slidingly engage either the first longitudinal groove or the second longitudinal groove.

2. The system of claim 1, wherein each self stopping hinge comprises:

one or more tubular structures fixedly coupled to the vertical component wherein each one or more tubular structures has an aperture sized to allow the frame member of the shelf component to rotate within the aperture, one or more cam-shaped members fixedly coupled to the frame member and aligned with the one or more tubular structures wherein the cam-shaped member includes a flat projecting surface, and at least one projection coupled to the vertical component positioned to abut the flat projecting surface of the cam-shaped member to prevent further rotation of the cam member.

3. The system of claim 1, wherein the first longitudinal groove and the second longitudinal groove have a dovetail cross-sectional shape.

4. The system of claim 3, wherein the vertical component has a cross-sectional dovetail shape sized to fit within the first longitudinal groove or the second longitudinal groove.

5. The system of claim 1, wherein the first longitudinal groove is laterally offset from the second longitudinal groove.

6. The system of claim 1, wherein each shelf component is formed from a flexible material and a support frame supporting the flexible material.

7. The system of claim 6, where the flexible material is selected from the group consisting of a wire mesh, canvas, leather and faux leather.

8. The system of claim 1, wherein each shelf component is formed from a material selected from the group consisting of wood, bamboo, laminated wood, metal, laser cut metal, polished aluminum, and plastic.

9. The system of claim 1, wherein the rectangular column is formed from a material selected from the group consisting of wood, bamboo, laminated wood, metal, polished aluminum, and plastic.

10. The system of claim 1, wherein the handle assembly is configured to removably couple to the upper end of the longitudinal support, the handle assembly comprising a handle having a hinge element to allow the handle to rotate around a lateral axis through an angular rotation path of approximately 180 degrees.

11. A paper storage system comprising:

a rectangular column having an upper portion, a lower portion, a first side, a second side, and a longitudinal axis, a first longitudinal groove defined within the first side of the rectangular column having a dovetail cross-sectional shape, a second longitudinal groove defined within the second side of the rectangular column having the dovetail cross-sectional shape, a base rotatably coupled to the lower portion of the rectangular column;

a handle assembly rotatably attachable to the upper portion of the rectangular column such that the handle assembly is able to rotate around an axis which is transverse to the longitudinal axis and such rotation is limited to 180 degrees;

a plurality of shelving units wherein each shelving unit comprises a vertical component having a dovetail cross-sectional shape and sized to slidingly engage and fit within either the first longitudinal groove or the second longitudinal groove;

a wire mesh shelf component coupled to the vertical component, and a plurality of spacers sized to slidingly engage either the first longitudinal groove or the second longitudinal groove;

a plurality of self stopping hinges coupled to corresponding vertical components, wherein each self-stopping hinge comprises:

one or more tubular structures fixedly coupled to the vertical component wherein each one or more tubular structures has an aperture sized to allow a frame member of the wire mesh shelf component to rotate within the aperture, one or more cam-shaped members fixedly coupled to the frame member and aligned with the one or more tubular structures wherein the cam-shaped member includes a flat projecting surface, and at least one projection coupled to the vertical component positioned to abut the flat projecting surface of the cam-shaped member to prevent further rotation of the cam member.

12. The system of claim 11, wherein the base is coupled to a plurality of retractable rollers.

* * * * *